US009852698B2

(12) United States Patent
Cho et al.

(10) Patent No.: US 9,852,698 B2
(45) Date of Patent: Dec. 26, 2017

(54) DISPLAY APPARATUS AND DRIVING METHOD THEREOF USING A TIME/SPACE DIVISION SCHEME

(71) Applicant: Samsung Display Co., Ltd., Yongin (KR)

(72) Inventors: Hyun Min Cho, Seoul (KR); Kwangkeun Lee, Osan-si (KR); Jae Byung Park, Seoul (KR); Jaehyun Cho, Seoul (KR); Seon-Tae Yoon, Seoul (KR); Hyundeok Im, Seoul (KR); Sung-Jin Hong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 263 days.

(21) Appl. No.: 14/249,039

(22) Filed: Apr. 9, 2014

(65) Prior Publication Data

US 2015/0116378 A1 Apr. 30, 2015

(30) Foreign Application Priority Data

Oct. 24, 2013 (KR) ..... 10-2013-0127432

(51) Int. Cl.
*G09G 3/36* (2006.01)
*G09G 3/34* (2006.01)

(52) U.S. Cl.
CPC ..... *G09G 3/3413* (2013.01); *G09G 3/342* (2013.01); *G09G 3/3648* (2013.01); *G09G 2300/0452* (2013.01); *G09G 2310/0235* (2013.01); *G09G 2320/0242* (2013.01); *G09G 2320/064* (2013.01); *G09G 2320/0646* (2013.01); *G09G 2360/16* (2013.01)

(58) Field of Classification Search
CPC ... G09G 2300/0452; G09G 2310/0235; G09G 2320/0242; G09G 2320/064; G09G 2320/0646; G09G 2360/16; G09G 3/3413; G09G 3/342; G09G 3/3648
See application file for complete search history.

(56) References Cited

U.S. PATENT DOCUMENTS 6,828,954 B2 12/2004 Yoshihara et al.
7,176,879 B1 * 2/2007 Yoshihara ..... G09G 3/3413 345/102

(Continued)

FOREIGN PATENT DOCUMENTS

KR 10-0831871 5/2008
KR 10-1314212 10/2013
KR 1020140071159 6/2014

*Primary Examiner* — Lun-Yi Lao
*Assistant Examiner* — Kelly Hegarty
(74) *Attorney, Agent, or Firm* — H.C. Park & Associates, PLC

(57) ABSTRACT

An image signal provided from an external device is converted into a data signal such that an image is displayed on a display panel, and a first light control signal and a second light control signal are output. A backlight unit provides the display panel with a first color light and a second color light different from the first color light in response to the first light control signal and the second control signal. The display panel driving unit also determines a pulse width of each of the first light control signal and the second light control signal according to a color characteristic of the image signal.

27 Claims, 30 Drawing Sheets

(56) References Cited

U.S. PATENT DOCUMENTS 7,333,165 B2 * 2/2008 Nakano ..... G02F 1/133621 345/102
7,492,345 B2 2/2009 Jin et al.
7,782,283 B2 * 8/2010 Hong ..... G09G 3/3413 345/102
7,893,915 B2 * 2/2011 Woo ..... G09G 3/3413 345/102
8,104,945 B2 1/2012 Kim et al.
8,253,317 B2 8/2012 Jeong et al.
8,274,471 B2 9/2012 Kim et al.
2006/0152468 A1 7/2006 Ozaki
2007/0024772 A1 * 2/2007 Childers ..... G09G 3/3413 349/68
2007/0109252 A1 * 5/2007 Shin ..... G09G 3/3413 345/102
2007/0152953 A1 * 7/2007 Hong ..... G09G 3/3413 345/102
2007/0182682 A1 * 8/2007 Hong ..... G09G 3/3413 345/88
2007/0200807 A1 * 8/2007 Lee ..... G09G 3/3413 345/88
2009/0174638 A1 * 7/2009 Brown Elliott ... G02F 1/133621 345/88
2010/0073275 A1 * 3/2010 Kim ..... G09G 3/342 345/102
2010/0141871 A1 * 6/2010 Hsu ..... G09G 3/3413 345/102
2010/0265281 A1 * 10/2010 Furukawa ..... G09G 3/3413 345/691
2011/0267381 A1 * 11/2011 Yamazaki ..... G09G 3/3607 345/690
2012/0147062 A1 6/2012 Seo et al.
2013/0113847 A1 * 5/2013 Mori ..... G02F 1/133514 345/690
2013/0300771 A1 11/2013 Cho et al.

* cited by examiner

<Second Mode>

<Third Mode>

<Fourth Mode>

<Default>

<SDDk>

<Default>

<SDDk>

DISPLAY APPARATUS AND DRIVING METHOD THEREOF USING A TIME/SPACE DIVISION SCHEME

CROSS-REFERENCE TO RELATED APPLICATION

This application claims priority from and the benefit of Korean Patent Application No. 10-2013-0127432, filed on Oct. 24, 2013, which is hereby incorporated by reference for all purposes as if fully set forth herein.

BACKGROUND

Field

Exemplary embodiments of the present invention relate to a display device and a driving method thereof.

Discussion of the Background

As a flat panel display device, a liquid crystal display device may realize full color using a space division scheme. For this, a liquid crystal display panel may include red, green, and blue color filters that are iteratively arranged to correspond to each sub pixel in a one-to-one manner. A unit combination of red, green, and blue color filters may form a minimum unit for color realization, and full color may be implemented through a transmissivity difference between sub pixels of the liquid crystal display panel and a color combination of red, green, and blue color filters. The red, green, and blue color filters may be disposed at different spaces within the liquid crystal display panel. This may be referred to as a space division scheme.

By comparison, a time division scheme (or, a field sequential scheme) may implement a full color with high transmissivity and a low manufacturing cost. With the time division scheme, the liquid crystal display panel may not include a color filter, and red, green, and blue light sources may be disposed on the rear of the liquid crystal display panel to emit red, green, and blue color lights. Also, a unit frame may be divided into three sub-frames in time, and the red, green, and blue light sources may be on every sub frame such that red, green, and blue color images are sequentially realized. Thus, a viewer may recognize a full-color image such that red, green, and blue color images are mixed as a result of physiological visual sensation.

A conventional time division type liquid crystal display device may be advantageous in reducing manufacturing costs and improving transmissivity. On the other hand, a color breakup phenomenon in which red, green, and blue color images are separately recognized for an instant, resulting from eye blinking or the movement of either picture or viewer, may appear.

The above information disclosed in this Background section is only for enhancement of understanding of the background of the invention and, therefore, it may contain information that does not constitute prior art.

SUMMARY

Exemplary embodiments of the present invention provide a display device capable of providing full color on a display panel using a time/space division scheme.

Exemplary embodiments of the present invention also provide a method of driving a display device in which turn-on times of first and second light sources of a backlight unit may be adjusted according to a color characteristic of an image being displayed.

Additional features of the invention will be set forth in the description which follows, and in part will become apparent from the description, or may be learned from practice of the invention.

An exemplary embodiment of the present invention discloses a display device including a display panel; a display panel driving unit configured to convert an image signal provided from an external device into a data signal such that an image is displayed on the display panel, and to output a first light control signal and a second light control signal; and a backlight unit configured to provide the display panel with a first color light and a second color light different from the first color light in response to the first light control signal and the second control signal. The display panel driving unit is further configured to determine a pulse width of each of the first light control signal and the second light control signal according to a color characteristic of the image signal.

An exemplary embodiment of the present invention also discloses a method of driving a display device, the method including receiving an image signal; determining a pulse width of each of first light source control signals and second light source control signals according to a color characteristic of the image signal; and providing a first color light and a second color light during a time period corresponding to a pulse width of each of the first light source control signals and the second light source control signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
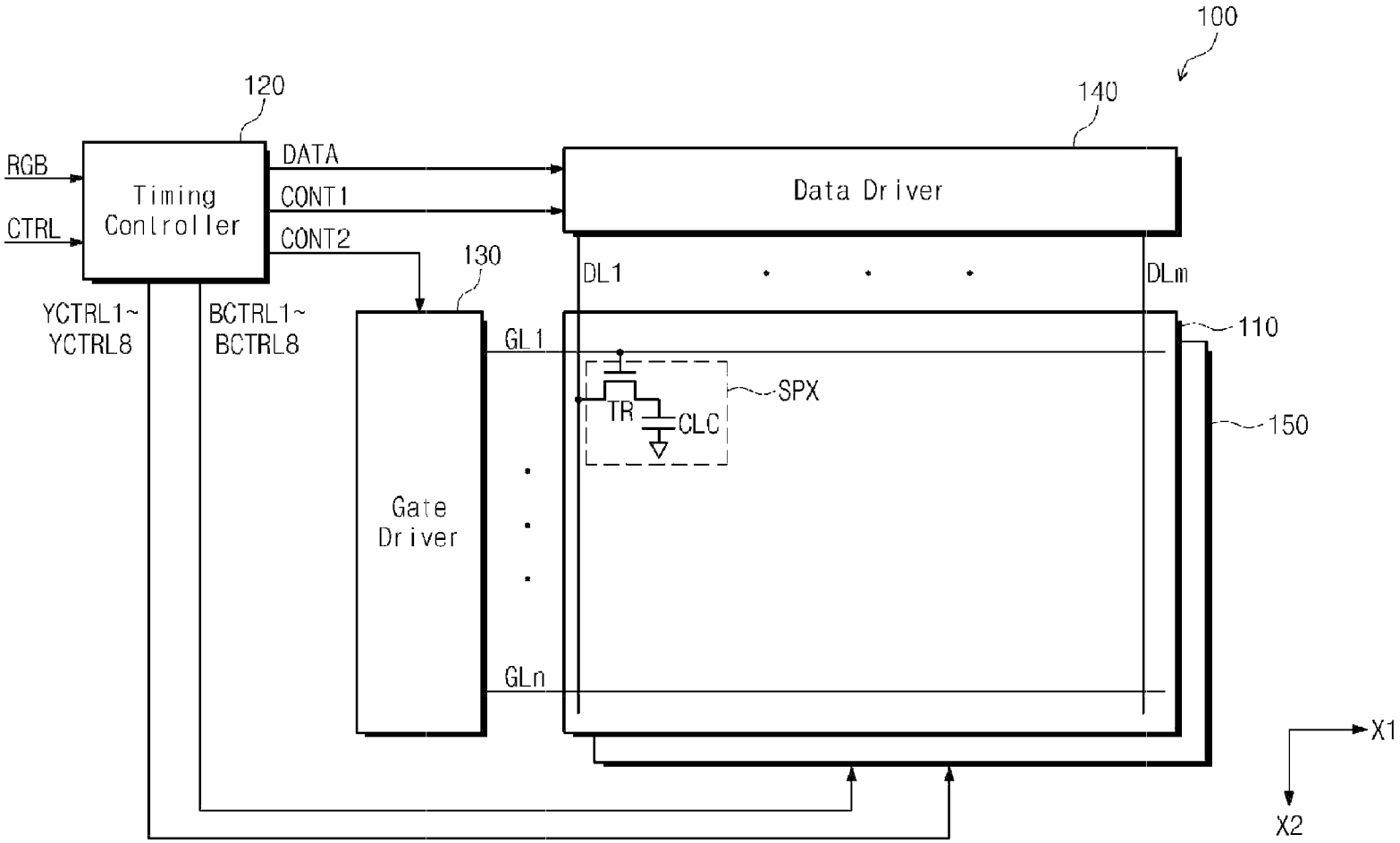
FIG. 1 is a block diagram schematically illustrating a display device according to an exemplary embodiment of present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a block diagram schematically illustrating a display device according to an exemplary embodiment of the present invention.

Referring to FIG. 1, a display device 100 may include a display panel 110, a timing controller 120, a gate driver 130, a data driver 140, and a backlight unit 150. The timing controller 120, the gate driver 130, and the data driver 140 may constitute a display panel driving unit that drives the display panel 110.

The display panel 110 may include gate lines GL1 to GLn extending along a first direction X1, data lines DL1 to DLm crossing the gate lines GL1 to GLn and extending along a second direction X2, and sub pixels SPX respectively arranged at intersections of the gate lines GL1 to GLn and the data lines DL1 to DLm. Here, n and m may be natural numbers not equal to 0. The gate lines GL1 to GLn and the data lines DL1 to DLm may be isolated from one another.

Each sub pixel SPX may have a switching transistor TR connected to a corresponding data line and a corresponding gate line, and a crystal capacitor CLC connected thereto.

The sub pixels SPX may each have the same structure. For ease of description, a single sub pixel will be described. The switching transistor TR of the sub pixel SPX may have a gate electrode connected to a gate line GL1 of the gate lines GL1 to GLn, a source electrode connected to a data line DL1 of the data lines DL1 to DLm, and a drain electrode connected to a first end of the crystal capacitor CLC. A second end of the crystal capacitor CLC may be connected to a common voltage. The switching transistor TR may be a thin film transistor.

The timing controller 120 may receive an image signal RGB and control signals CTRL for controlling a display of the image signal RGB from an external device. For example, the control signals CTRL may include a vertical synchronization signal, a horizontal synchronization signal, a main clock signal, a data enable signal, etc. Based on the control signals CTRL, the timing controller 120 may provide the data driver 140 with a first control signal CONT1 and a data signal DATA, obtained by processing the image signal RGB to be suitable for an operation condition of the display panel 110, and a second control signal CONT2 transmitted to the gate driver 130. The first control signal CONT1 may include a horizontal synchronization start signal, a clock signal, and a line latch signal, and the second control signal CONT2 may include a vertical synchronization start signal, an output enable signal, and a gate pulse signal. The timing controller 120 may output first light source control signals YCTRL1 to YCTRL8 and second light source control signals BCTRL1 to BCTRL8 to control the backlight unit 150.

The data driver 140 may output gradation voltages for driving the data lines DL1 to DLm according to the data signal DATA and the first control signal CONT1 from the timing controller 120.

The gate driver 130 may drive the gate lines GL1 to GLn in response to the second control signal CONT2 from the timing controller 120. The gate driver 130 may include one or more gate driver ICs. The gate driver 130 may be implemented by not only the gate driver ICs, but also circuits using ASG (Amorphous Silicon Gate) using an amorphous Silicon Thin Film Transistor (a-Si TFT), an oxide semiconductor, a crystalline semiconductor, a poly-crystalline semiconductor, etc.

When a gate-on voltage is applied to a gate line by gate driver 130, a row of switching transistors connected to the gate line may be turned on. At this time, the data driver 140 may provide the data lines DL1 to DLm with gradation voltages corresponding to a data signal DATA. The gradation voltages provided to the data lines DL1 to DLm may be applied to corresponding sub pixels through turn-on of the switching transistors. Here, a time period in which switching transistors in a row are turned on, that is, periods of an output enable signal and a gate pulse signal, may be referred to as a 1-horizontal period or 1H.

The backlight unit 150 may be disposed on the rear of the display panel 110, and may provide a light from the rear of the display panel 110. The backlight unit 150 may include a light source formed of a plurality of light-emitting diodes (not shown). In this case, the light-emitting diodes may be arranged on a printed circuit board in a stripe shape along one direction or in a matrix shape.

Figure 2:
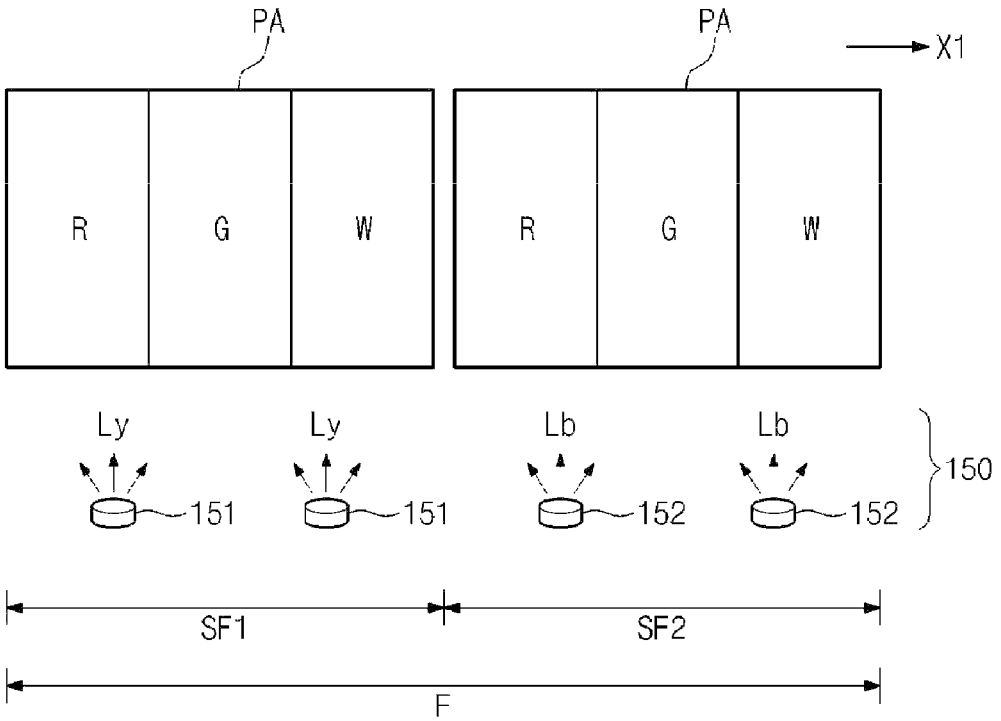
FIG. 2 is a diagram showing a full-color realizing principle using a time/space division scheme of the display device shown in FIG. 1.

FIG. 2 is a diagram showing a full-color realizing principle using a time/space division scheme of a display device shown in FIG. 1.

Referring to FIG. 2, a first color filter R and a second color filter G having different colors may be provided within a display panel 110 (refer to FIG. 1) to realize full color using a time/space division scheme. For example, the first color filter R may be a red color filter having a red color, and the second color filter G may be a green color filter having a green color. However, the first color filter R and the second color filter G may not be limited to this. Assuming that an area corresponding to a pixel is defined as a pixel area PA, each pixel area PA may have the first color filter R and the second color filter G. Also, each pixel area PA may have an open portion W. The first color filter R, the second color filter G, and the open portion W may be formed sequentially along a first direction X1. The first color filter R, the second color filter G, and the open portion W may correspond to three sub pixels, respectively. The open portion W may be implemented by a transparent filter on the same surface as the first color filter R and the second color filter G.

A backlight unit 150 may include a first light source 151 for generating a first color light Ly, and a second light source 152 for generating a second color light Lb. A unit frame F may be temporally divided into a first sub frame SF1 and a second sub frame SF2. During a period of the first sub frame SF1, the first light source 151 of the backlight unit 150 may be driven. That is, during a period of the first sub frame SF1, the first color light Ly may be provided to the display panel 110. Afterwards, during a period of the second sub frame SF2, the second light source 152 of the backlight unit 150 may be driven such that the second color light Lb is provided to the display panel 110. If a frequency of the unit frame F is 60 Hz, each of the first sub frame SF1 and the second sub frame SF2 may have a frequency of 120 Hz.

In exemplary embodiments, the first color light Ly from the first light source 151 may be yellow, and the second color light Lb from the second light source 152 may be blue. If the first color light Ly is yellow, the first color light Ly may include red and green light components.

Thus, a red light component of the first color light Ly generated from the backlight unit 150 during a period of the first sub frame SF1 may pass through the first color filter R to be displayed as a red image. A green light component of the first color light Ly may pass through the second color filter G to be displayed as a green image. Also, the first color light Ly may pass through the open portion W to be displayed as a yellow image.

Afterwards, the second color light Lb generated from the backlight unit 150 during a period of the second sub frame SF2 may pass through the open portion W to be displayed as a blue image.

As described above, the open portion W may be prepared to provide a space capable of displaying a yellow image during a period of the first sub frame SF1, and a blue image during a period of the second sub frame SF2. A white may be recognized by displaying a yellow image and a blue image alternately in the time division manner. Therefore, the open portion W may eliminate a color breakup phenomenon generated as a result of time division, with a resulting improvement in luminance. A size of the open portion W may be selected to provide proper transmissivity, considering luminance and the color of a target frame.

Full color may be realized through a time/space division scheme by displaying a red image and a green image through the space division scheme using the first color filter R and the second color filter G, and alternately displaying a yellow image and a blue image through the time division scheme.

Figure 3:
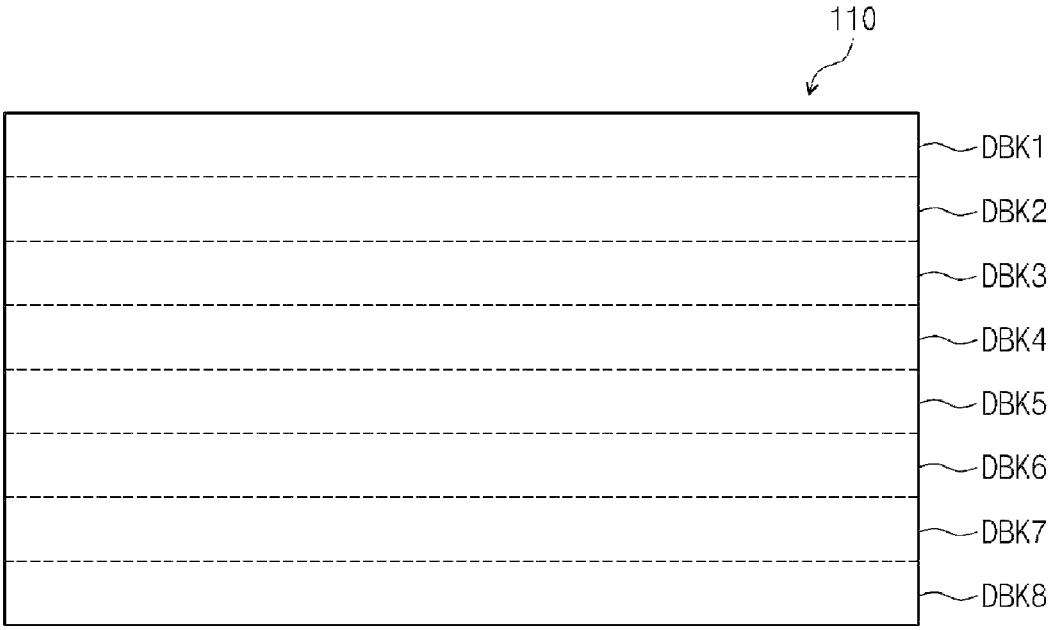
FIG. 3 is a diagram schematically illustrating the display panel shown in FIG. 1.

FIG. 3 is a diagram schematically illustrating the display panel 110 shown in FIG. 1.

Referring to FIG. 3, the display panel 110 may be divided into display blocks DBK1 to DBK8. In FIG. 3, for example, the display panel 110 is divided into eight display blocks DBK1 to DBK8. However, present invention is not limited thereto, and different numbers and sizes of display blocks may be made.

Figure 4:
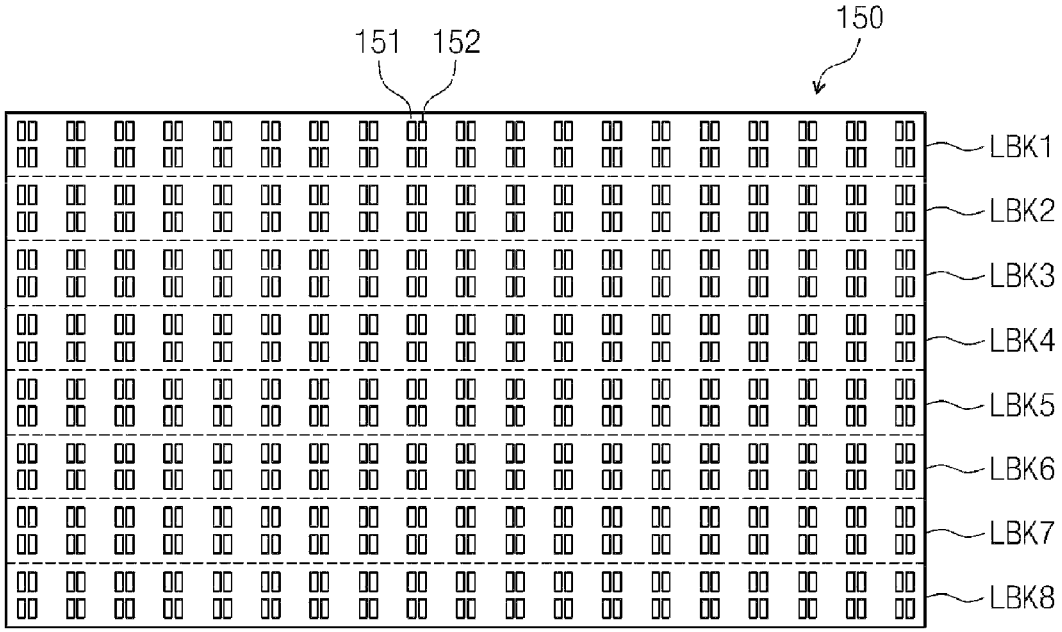
FIG. 4 is a diagram schematically illustrating an arrangement of light sources in the backlight unit shown in FIG. 1, according to an exemplary embodiment of the present invention.

FIG. 4 is a diagram schematically illustrating an arrangement of light sources in the backlight unit shown in FIG. 1, according to an exemplary embodiment of the present invention.

Referring to FIG. 4, a backlight unit 150 may be placed at the rear of a display panel 110 shown in FIG. 3, and may supply a light to the display panel 110. The backlight unit 150 may include light source blocks LBK1 to LBK8 respectively corresponding to display blocks DBK1 to DBK8 of the display panel 110. Each of the light source blocks LBK1 to LBK8 may include a plurality of first light sources 151 and a plurality of second light sources 152. A first light source 151 and a second light source 152 that are disposed to be adjacent to each other may constitute a light source pair. Light source pairs may be arranged in a matrix shape. In exemplary embodiments, a first color light Ly from the first light source 151 may be a light having a yellow color, and a second color light Lb provided from the second light source 152 may be a light having a blue color.

Figure 5:
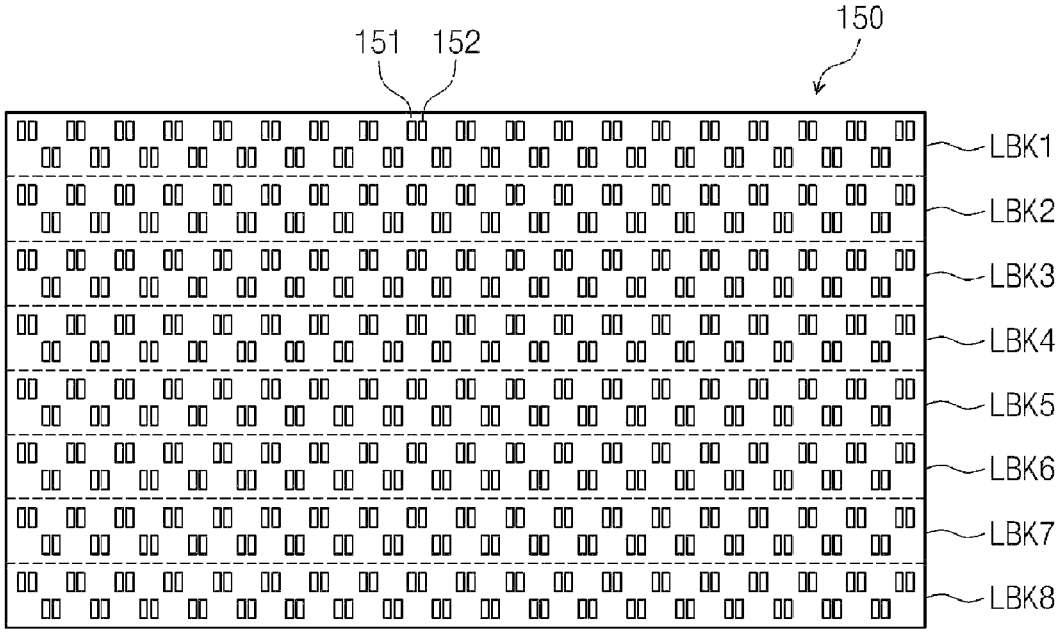
FIG. 5 is a diagram schematically illustrating an arrangement of light sources in the backlight unit shown in FIG. 1, according to an exemplary embodiment of the present invention.

FIG. 5 is a diagram schematically illustrating an arrangement of light sources in a backlight unit shown in FIG. 1, according to another exemplary embodiment of the present invention.

Referring to FIG. 5, a backlight unit 150 may be placed at the rear of the display panel 110 shown in FIG. 3, and may supply a light to the display panel 110. The backlight unit 150 may include light source blocks LBK1 to LBK8 respectively corresponding to display blocks DBK1 to DBK8 of the display panel 110. Each of the light source blocks LBK1 to LBK8 may include a plurality of first light sources 151 and a plurality of second light sources 152. A first light source 151 and a second light source 152 that are disposed to be adjacent to each other may constitute a light source pair. Unlike a backlight unit 150 shown in FIG. 4, odd-numbered lines of light source pairs and even-numbered lines of light source pairs may be alternately disposed along a second direction X2 of the backlight unit 150 shown in FIG. 5. The arrangement of light sources LED of the backlight unit 150 shown in FIG. 5 may be different from the arrangement of light sources LED of the backlight unit 150 shown in FIG. 4. However, the backlight unit 150 shown in FIG. 5 may be the same as the backlight unit 150 shown in FIG. 4 in that it is divided into light source blocks LBK1 to LBK8.

Figure 6:
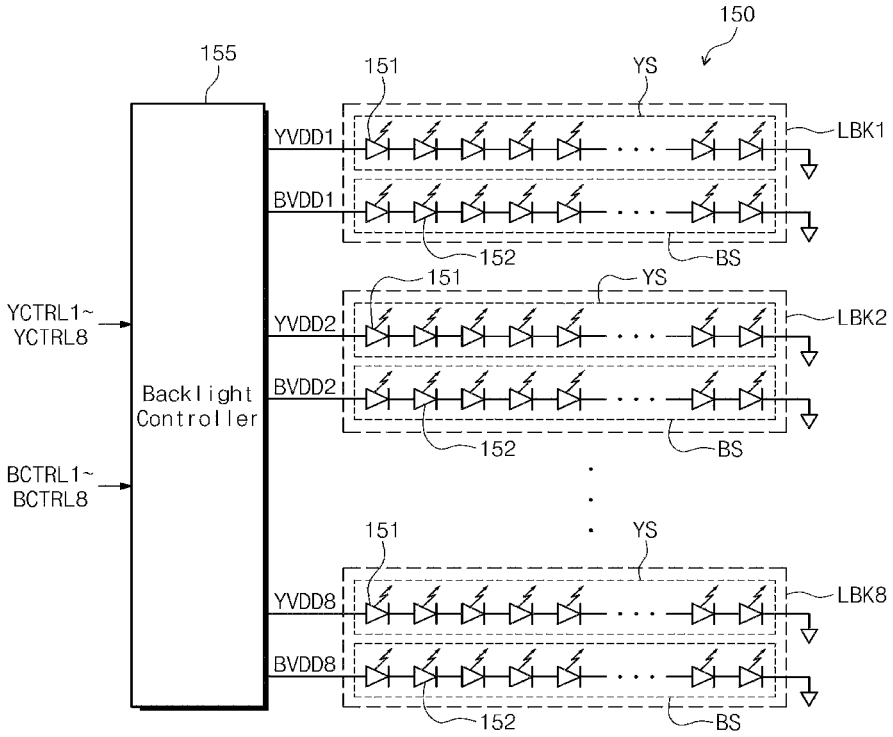
FIG. 6 is a block diagram schematically illustrating the backlight unit shown in FIG. 1.

FIG. 6 is a block diagram schematically illustrating the backlight unit shown in FIG. 1.

Referring to FIG. 6, a backlight unit 150 may include the backlight controller 155 and light source blocks LBK1 to LBK8. The backlight controller 155 may receive first light source control signals YCTRL1 to YCTRL8, and second light source control signals BCTRL1 to BCTRL8 from the timing controller 120 shown in FIG. 1 to generate first light source voltages YVDD1 to YVDD8 and second light source voltages BVDD1 to BVDD8 that supply a power to light source blocks LBK1 to LBK8.

Each of the light source blocks LBK1 to LBK8 may include a first light source string YS, including first light sources 151 connected in series and a second light source string BS including second light sources 152 connected in series.

First light source strings YS in the light source blocks LBK1 to LBK8 may be supplied with first light source voltages YVDD1 to YVDD8 from the backlight controller 155, and second light source strings BS in the light source blocks LBK1 to LBK8 may be supplied with second light source voltage BVDD1 to BVDD8 from the backlight controller 155.

Figure 7:
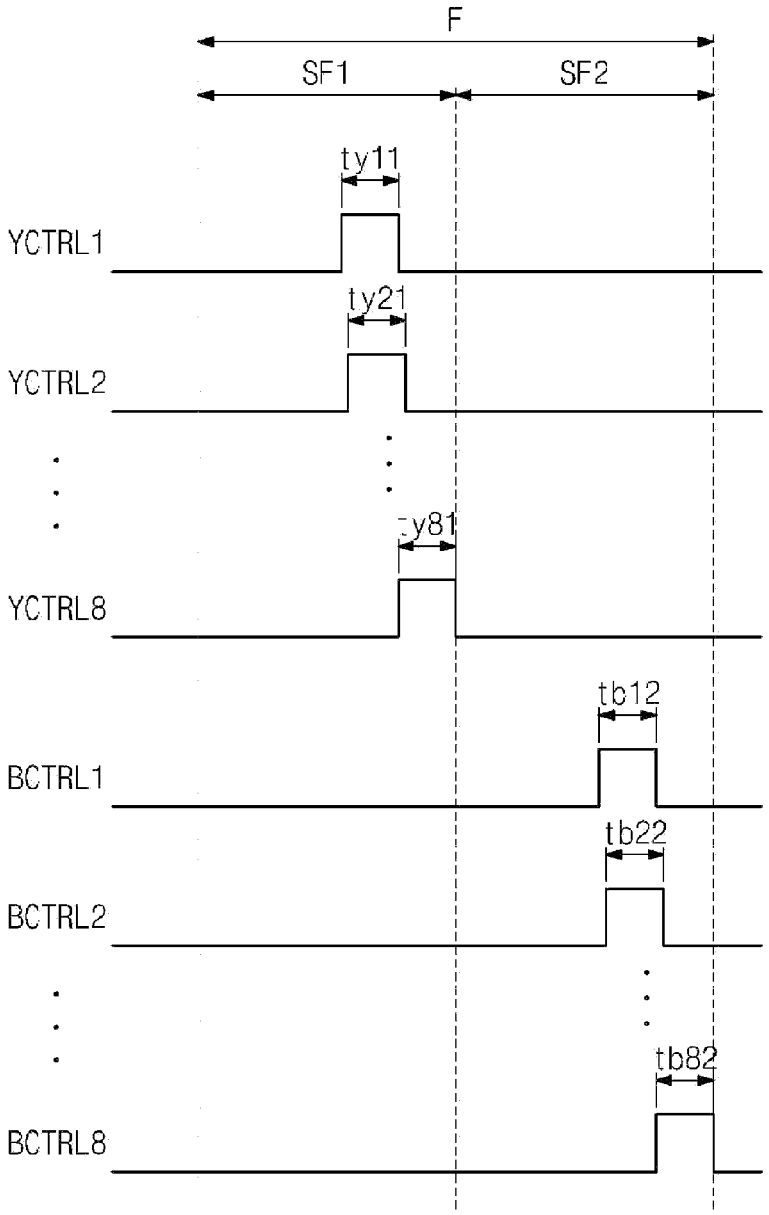
FIG. 7 is a timing diagram showing signals provided from the timing controller shown in FIG. 1 to the backlight controller shown in FIG. 6.

FIG. 7 is a timing diagram showing signals provided from the timing controller 120 shown in FIG. 1 to the backlight controller 155 shown in FIG. 6.

Referring to FIG. 7, first light source control signals YCTRL1 to YCTRL8 provided from the timing controller 120 shown in FIG. 1 may be sequentially activated within a period of a first sub frame SF1, and second light source control signals BCTRL1 to BCTRL8 may be sequentially activated within a period of a second sub frame SF2.

As illustrated in FIG. 3, the display panel 110 may be divided into display blocks DKB1 to DBK8, and gate lines GL1 to GLn may be sequentially driven. Because light source blocks LBK1 to LBK8 shown in FIG. 6 correspond to the display blocks DKB1 to DBK8, the first light source control signals YCTRL1 to YCTRL8 and the second light source control signals BCTRL1 to BCTRL8 may be sequentially driven.

In FIG. 7, the first light source control signals YCTRL1 to YCTRL8 are sequentially activated within a section of a period of the first sub frame SF1, and the second light source control signals BCTRL1 to BCTRL8 are sequentially activated within a section of a period of the second sub frame SF2. However, the first light source control signals YCTRL1 to YCTRL8 may be activated within the second sub frame SF2 as well as the first sub frame SF1. The second light source control signals BCTRL1 to BCTRL8 may be activated within the first sub frame SF1 as well as the second sub frame SF2. Also, active periods ty11 to ty81 of the first light source control signals YCTRL1 to YCTRL8 may have the same length, and active periods tb12 to tb82 of the second light source control signals BCTRL1 to BCTRL8 may have the same length. However, the present invention is not limited thereto. The active periods ty11 to ty81 may represent pulse widths of the first light source control signals YCTRL1 to YCTRL8, respectively. The active periods tb12 to tb82 may represent pulse widths of the second light source control signals BCTRL1 to BCTRL8. Below, a method of changing widths of the active periods ty11 to ty81 of the first light source control signals YCTRL1 to YCTRL8 and widths of the active periods tb12 to tb82 of the second light source control signals BCTRL1 to BCTRL8 will be described.

Figure 8:
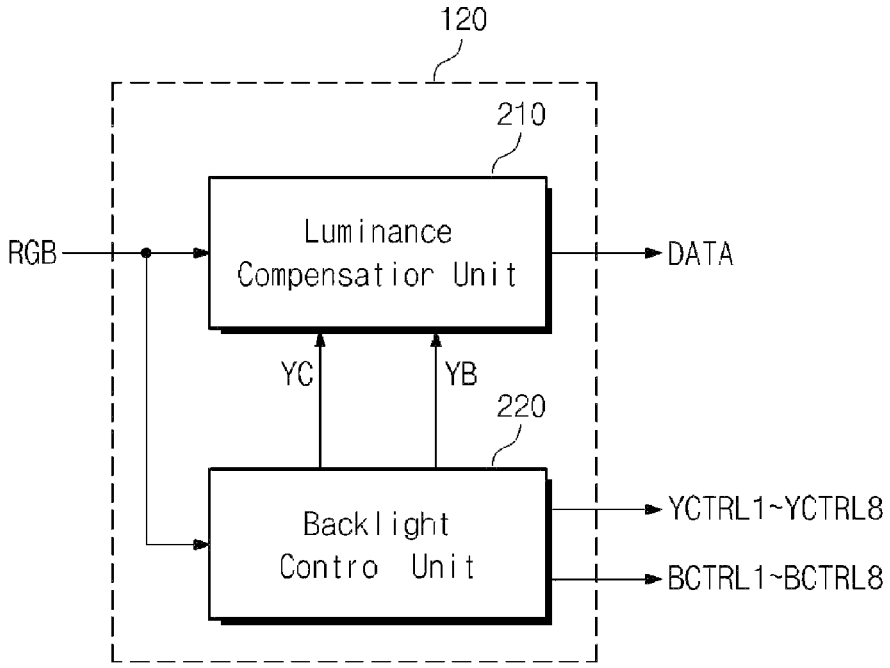
FIG. 8 is a block diagram schematically illustrating the timing controller shown in FIG. 1.

FIG. 8 is a block diagram schematically illustrating the timing controller shown in FIG. 1.

Referring to FIG. 8, a timing controller 120 may comprise a luminance compensation unit 210 and a backlight control unit 220. The backlight control unit 220 may output first light source control signals YCTRL1 to YCTRL8 and second light source control signals BCTRL1 to BCTRL8 being provided to the backlight controller 155 shown in FIG. 1 in response to an image signal RGB provided from an external device. The backlight control unit 220 may output a first luminance compensation signal YC and a second luminance compensation signal BC in response to the image signal RGB. The luminance compensation unit 210 may compensate the luminance of the image signal RGB in response to the first luminance compensation signal YC and the second luminance compensation signal BC, and may output a data signal DATA as the compensation result to a data driver 140 shown in FIG. 1.

Figure 9:
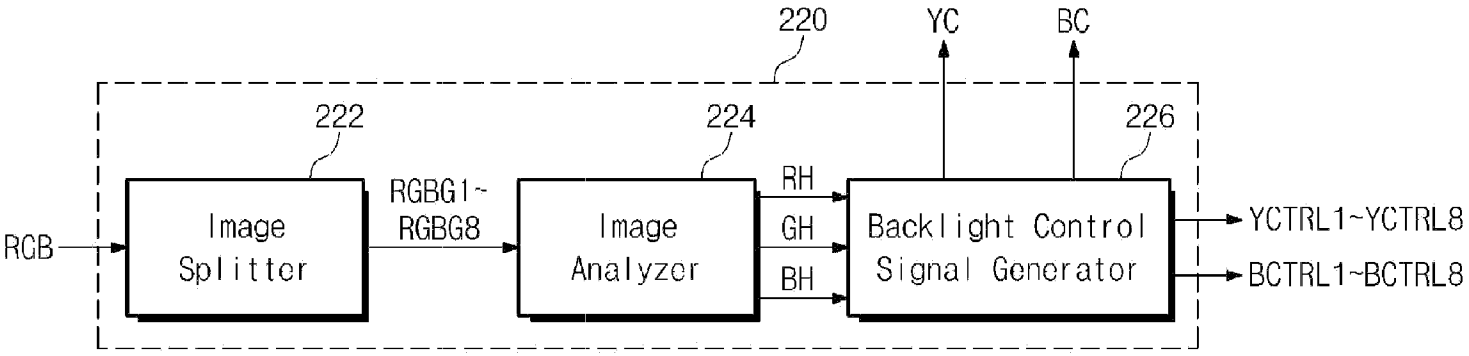
FIG. 9 is a block diagram schematically illustrating the backlight control unit shown in FIG. 8.

FIG. 9 is a block diagram schematically illustrating the backlight control unit shown in FIG. 8.

Referring to FIG. 9, a backlight control unit 220 may include an image splitter 222, an image analyzer 224, and a backlight control signal generator 226. The image splitter 222 may divide a frame of image signal RGB input from an external device into image groups RGBG1 to RGBG8 respectively corresponding to display blocks DBK1 to DBK8 shown in FIG. 3.

The image analyzer 224 may output a first frequency signal RH corresponding to the frequency of each gradation of a red color, a second frequency signal GH corresponding to the frequency of each gradation of a green color, and a third frequency signal BH corresponding to the frequency of each gradation of a blue color, where the red, green, and blue colors are included in each of the image groups RGBG1 to RGBG8 from the image splitter 222.

The backlight control signal generator 226 may determine an image type of each of the image groups RGBG1 to RGBG8 based on the first frequency signal RH, the second frequency signal GH, and the third frequency signal BH, and may output first light source control signals YCTRL1 to YCTRL8 and second light source control signals BCTRL1 to BCTRL8 corresponding to the determined image type. The backlight control signal generator 226 may output a first luminance compensation signal YC and a second luminance compensation signal BC corresponding to the determined image type.

Figure 10:
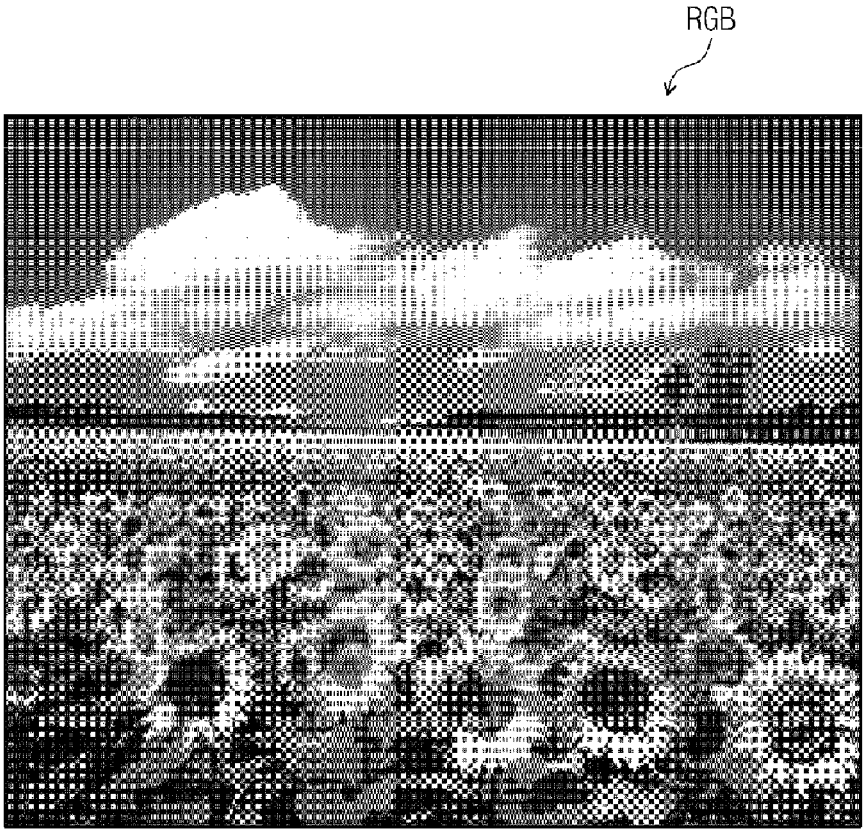
FIG. 10 is a diagram showing a frame of an image signal provided to the image splitter shown in FIG. 9, according to an exemplary embodiment of the present invention.
Figure 11:
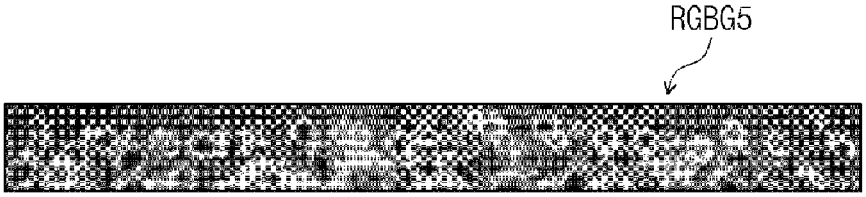
FIG. 11 is a diagram showing an image corresponding to a preselected display block in the display panel shown in FIG. 3, from the image shown in FIG. 10.
Figure 12A:
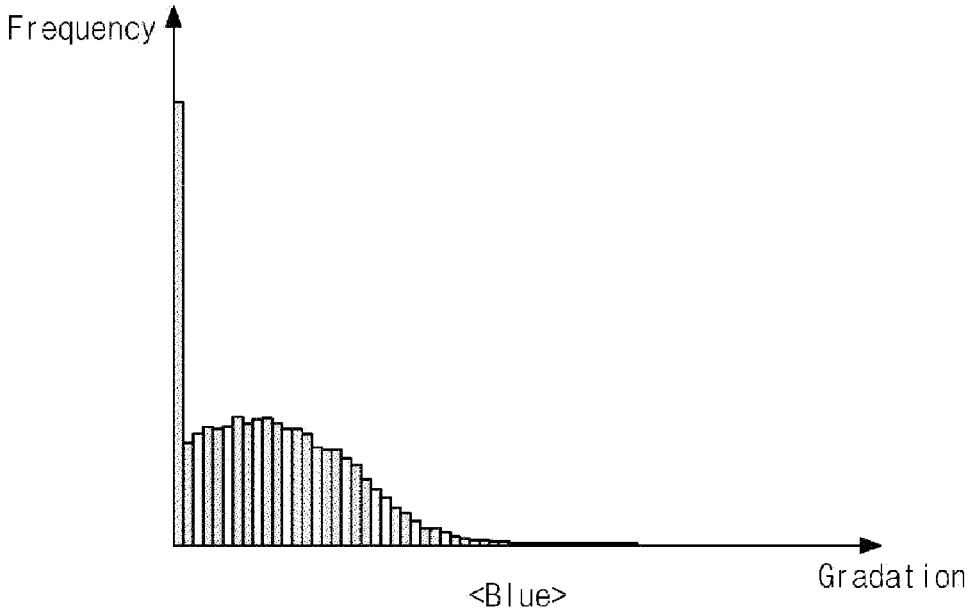
FIGS. 12A and 12B are diagrams showing a histogram analysis result of the image analyzer shown in FIG. 9 on an image corresponding to the preselected display block shown in FIG. 11.
Figure 12B:
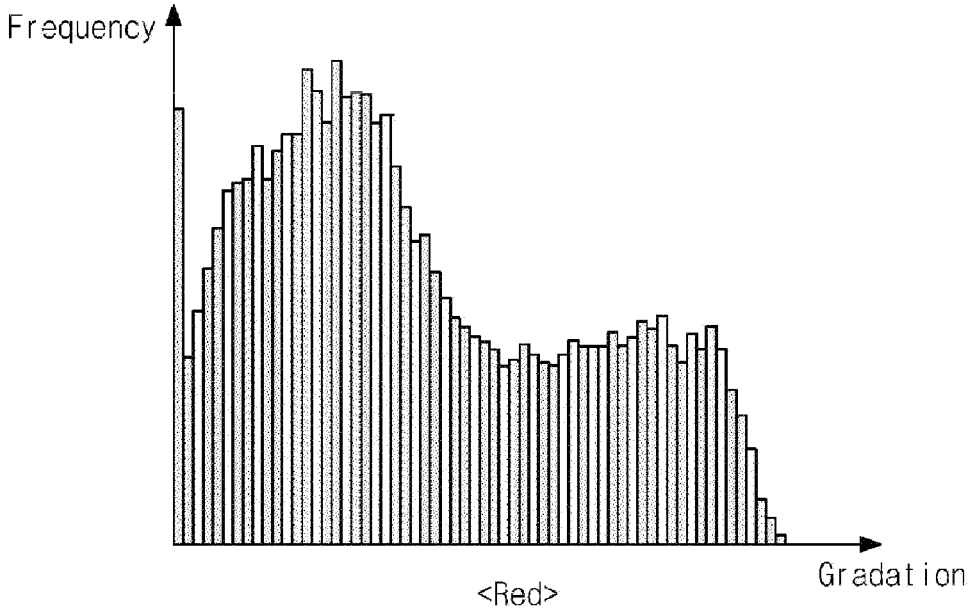

FIG. 10 is a diagram showing a frame of image signal provided to an image splitter shown in FIG. 9, according to an exemplary embodiment of the present invention. FIG. 11 is a diagram showing an image corresponding to a preselected display block in the display panel 110 shown in FIG. 3, from the image shown in FIG. 10. FIGS. 12(A) and 12(B) are diagrams showing a histogram analysis result of an image analyzer shown in FIG. 9 on an image corresponding to the preselected display block shown in FIG. 11.

Referring to FIGS. 9, 10, 11, 12(A), and 12(B), an image signal RGB, including a sky expressed by a blue color and a sun flower expressed by a yellow color, may be provided to the image splitter 222. The image splitter 222 may divide a frame of image signal RGB into image groups RGBG1 to RGBG8 respectively corresponding to display blocks DBK1 to DBK8 of the display panel 110 shown in FIG. 3. For example, the histograms shown in FIGS. 12(A) and 12(B) may be calculated when the image analyzer 224 performs histogram analysis on an image group RGBG5, corresponding to a display block DBK5, from among an image signal RGB shown in FIG. 10. As illustrated in FIGS. 12(A) and 12(B), a frequency of occurrence of a red color of the image group RGBG5, including the sun flower, may be greater than that of a green color thereof. In this case, the display quality of an image displayed on the display panel 110 may be improved by making a turn-on time period of a first light source 151 (refer to FIG. 6) for providing a yellow light become longer than that of a second light source 152 (refer to FIG. 6) for providing a blue light.

The backlight control unit 220 shown in FIG. 8 may improve the display quality of an image by setting pulse widths of first light source control signals YCTRL1 to YCTRL8 and second light source control signals BCTRL1 to BCTRL8 according to color characteristics of image groups RGBG1 to RGBG8.

FIGS. 13 to 16 are diagrams for describing a technique of setting pulse widths of first light source control signals and second light source control signals according to color characteristics of image groups. For ease of description, various exemplary embodiments will be described based on a first light control signal YCTRL1 and a second light control signal BCTRL1 that are generated from a backlight control unit 220 shown in FIG. 8 and correspond to a light source block LBK1. Likewise, a backlight control unit 220 may generate first light source control signals YCTRL2 to YCTRL8 and second light source control signals BCTRL2 to BCTRL8 in the same manner. Referring to FIGS. 13 to 16, the backlight control unit 220 may have first to fourth modes.

Figure 13:
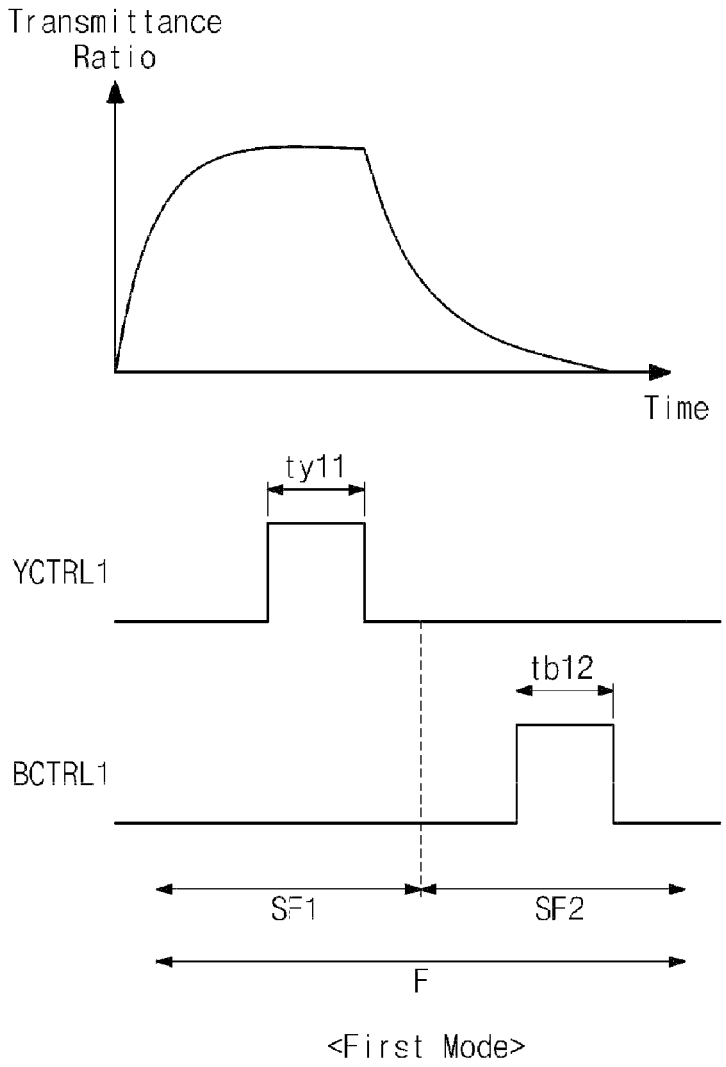
FIGS. 13 to 16 are diagrams for describing a technique of setting pulse widths of first light source control signals and second light source control signals according to color characteristics of various image groups.

Referring to FIGS. 9 and 13, the backlight control signal generator 226 of the backlight control unit 220 may determine an image type of each of image groups RGBG1 to RGBG8 in response to a first frequency signal RH, a second frequency signal GH, and a third frequency signal BH from the image analyzer 224.

The following Table 1 shows a case where the backlight control unit 220 operates in the first mode. In the following tables 1, 2, 3, and 4, 'R' may indicate a red color, 'G' may indicate a green color, 'B' may indicate a blue color, 'Y' may indicate a yellow color, and 'CBU' may indicate color breakup.

TABLE 1

| Type | Field Split | Decrease | Increase | Objects |
|---|---|---|---|---|
| SDD2 | No | YCTRL | BCTRL | B color sense reinforcement |
| SDD3 | No | YCTRL | YCTRL, BCTRL | B color sense reinforcement |
| SDD4 | No | YCTRL | No | Power consumption reduction color mixing improvement |
| SDD5 | No | BCTRL | YCTRL | R/G improvement |
| SDD8 | No | BCTRL | No | Power consumption reduction color mixing improvement |
| SDD12 | No | YCTRL, BCTRL | No | Power consumption reduction color mixing improvement |

TABLE 1-continued

| Type | Field Split | Decrease | Increase | Objects |
|---|---|---|---|---|
| SDD13 | No | No | YCTRL | R/G/Y color sense reinforcement |
| SDD14 | No | No | BCTRL | B color sense reinforcement |
| SDD15 | No | No | YCTRL, BCTRL | R/G/Y/B color sense reinforcement |
| Default | No | No | No | Default driving |

When an image type of the image group RGBG1 is one of SDD2 to SDD15, the backlight control signal generator 226 may output a first mode of first light control signal YCTRL1 and second light control signal BCTRL1 shown in FIG. 13. During the first mode, the first light control signal YCTRL1 generated by the backlight control signal generator 226 may be activated within a portion of a period of a first sub frame SF1, and the second light control signal BCTRL1 may be activated within a portion of a period of a second sub frame SF2.

During an active period ty11 of the first light control signal YCTRL1, a first light source voltage YVDD1 may be supplied to a first light source string YS shown in FIG. 6. During an active period tb12 of the second light control signal BCTRL1, a second light source voltage BVDD1 may be supplied to a second light source string BS shown in FIG. 6. That is, the active period ty11 of the first light control signal YCTRL1 may be a turn-on time period of the first light source string YS, and the active period tb12 of the second light control signal BCTRL1 may be a turn-on time period of the second light source string BS. Each of the active period ty11 of the first light control signal YCTRL1 and the active period tb12 of the second light control signal BCTRL1 may be determined according to an image type of the image group RGBG1.

For example, in the event that an image type of the image group RGBG1 is determined to be 'SDD5' through the backlight control signal generator 226, the active period tb12 of the second light control signal BCTRL1 may decrease, and the active period ty11 of the first light control signal YCTRL1 may increase. The active period tb12 of the second light control signal BCTRL1 and the active period ty11 of the first light control signal YCTRL1 may increase or decrease from an initial setup time of a default state. An increment or decrement of the active period tb12 of the second light control signal BCTRL1 and the active period ty11 of the first light control signal YCTRL1 may be optimally determined at a test level of a fabricating process of a display device 100.

The following Table 2 shows a case where the backlight control unit 220 operates in the second mode.

TABLE 2

| Type | Field Split | Decrease | Increase | Objects |
|---|---|---|---|---|
| SDD18 | YCTRL, BCTRL | YCTRL | BCTRL | CBU improvement B color sense reinforcement |
| SDD20 | YCTRL, BCTRL | YCTRL | No | CBU improvement power consumption reduction |
| SDD21 | YCTRL, BCTRL | BCTRL | YCTRL | CBU improvement R/G improvement |
| SDD24 | YCTRL, BCTRL | BCTRL | No | CBU improvement power consumption reduction |
| SDD28 | YCTRL, BCTRL | BCTRL | No | CBU improvement power consumption reduction |
| SDD29 | YCTRL, BCTRL | No | YCTRL | CBU improvement R/G improvement |

TABLE 2-continued

| Type | Field Split | Decrease | Increase | Objects |
|---|---|---|---|---|
| SDD32 | YCTRL, BCTRL | No | No | CBU improvement |

Figure 14:
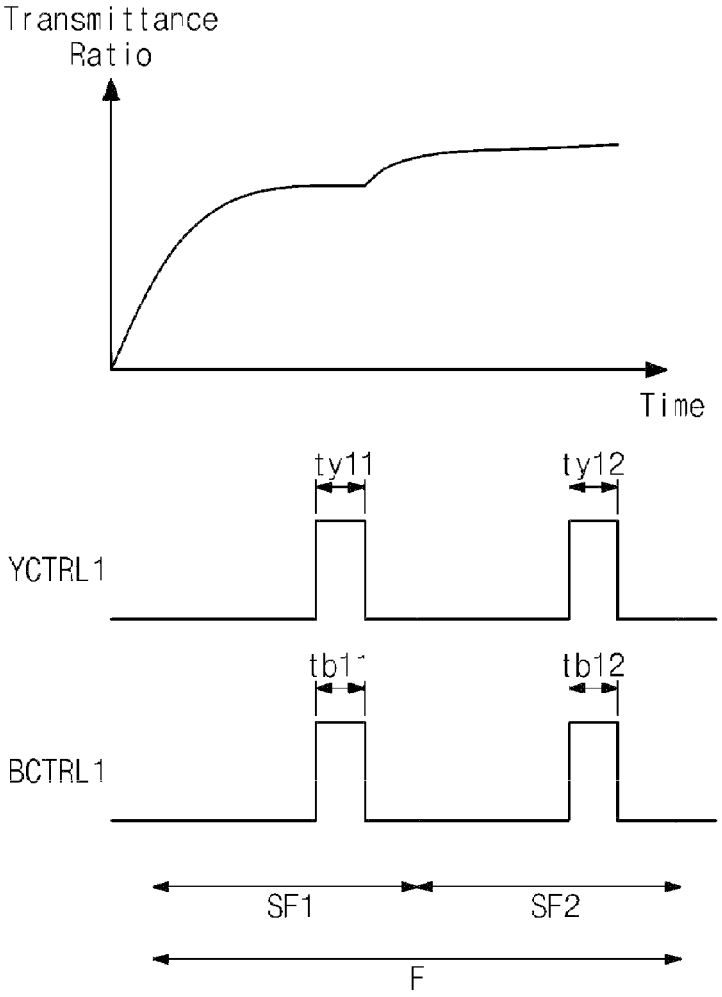

Referring to FIG. 14 and Table 2, when an image type of the image group RGBG1 is one of SDD18 to SDD32, the backlight control signal generator 226 may output a second mode of first light control signal YCTRL1 and second light control signal BCTRL1 shown in FIG. 13. During the second mode, the first light control signal YCTRL1 generated by the backlight control signal generator 226 may be activated within a part of a period of the first sub frame SF1 and within a part of a period of the second sub frame SF2, and the second light control signal BCTRL1 may be activated within a part of a period of the first sub frame SF1 and within a part of a period of a second sub frame SF2. The second mode may be a filed split mode where the first light control signal YCTRL1 and the second light control signal BCTRL1 are divided and activated into the first sub frame SF1 and the second sub frame SF2.

During the second mode, the backlight control signal generator 226 may change widths of active periods ty11 and ty12 of the first light control signal YCTRL1 and widths of active periods tb11 and tb12 of the second light control signal BCTRL1, respectively. For example, in the event that the backlight control signal generator 226 shown in FIG. 9 determines an image type of the image group RGBG1 as SDD20, it may decrease the active period tb12 of the first light control signal YCTRL1, and may maintain the active period tb11 of the second light control signal BCTRL1 with the initial setup time.

A color breakup phenomenon may be reduced by increasing or decreasing the active period ty11 of the first light control signal YCTRL1 and the active period tb12 of the second light control signal BCTRL1 according to a color characteristic of an image signal RGB.

The following Table 3 shows a case where the backlight control unit 220 operates at the third mode.

TABLE 3

| Type | Field Split | Decrease | Increase | Objects |
|---|---|---|---|---|
| SDD34 | YCTRL | YCTRL | BCTRL | CBU improvement |
| SDD36 | YCTRL | YCTRL | No | CBU improvement power consumption reduction |
| SDD37 | YCTRL | BCTRL | YCTRL | CBU improvement R/G/Y color sense improvement |
| SDD40 | YCTRL | BCTRL | No | CBU improvement power consumption reduction |
| SDD44 | YCTRL | YCTRL, BCTRL | No | CBU improvement power consumption reduction |
| SDD45 | YCTRL | No | YCTRL | CBU improvement R/G Desaturation improvement |
| SDD46 | YCTRL | No | BCTRL | CBU improvement B color sense improvement |
| SDD47 | YCTRL | No | YCTRL, BCTRL | CBU improvement R/G/Y/B color sense improvement |
| SDD48 | YCTRL | No | No | CBU improvement |

Figure 15:
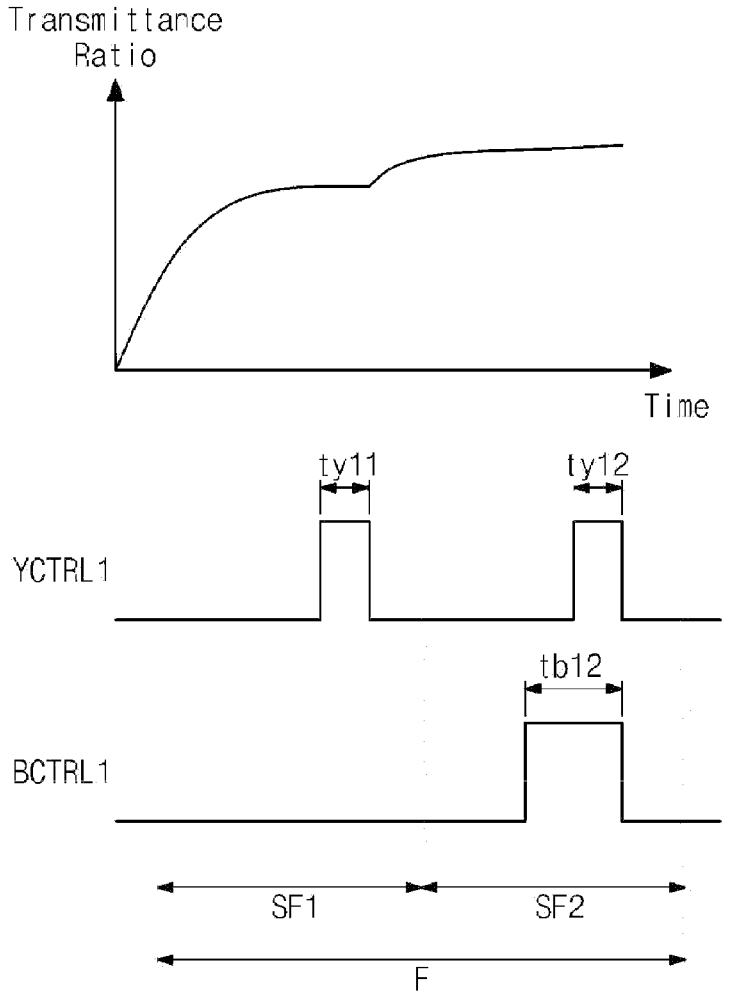

Referring to FIG. 15 and Table 3, when an image type of the image group RGBG1 is one of SDD34 to SDD48, the backlight control signal generator 226 may output a third mode of first light control signal YCTRL1 and second light control signal BCTRL1. During the third mode, the first light control signal YCTRL1 generated by the backlight control signal generator 226 may be activated within a portion of a period of the first sub frame SF1 and within a portion of a period of the second sub frame SF2, and the second light control signal BCTRL1 may be activated within a portion of a period of a second sub frame SF2. The third mode may be a filed split mode where the first light control signal YCTRL1 is divided and activated into the first sub frame SF1 and the second sub frame SF2.

During the third mode, the backlight control signal generator 226 may change the widths of active periods ty11 and ty12 of the first light control signal YCTRL1 and a width of an active period tb12 of the second light control signal BCTRL1, respectively. For example, in the event that the backlight control signal generator 226 shown in FIG. 9 determines an image type of the image group RGBG1 as SDD47, it may increase the widths of the active periods ty11 and ty12 of the first light control signal YCTRL1 and a width of the active period tb12 of the second light control signal BCTRL1.

The following table 3 shows a case where the backlight control unit 220 operates in the fourth mode.

TABLE 4

| Type | Field Split | Reduction | Decrease | Increase |
|---|---|---|---|---|
| SDD50 | BCTRL | YCTRL | BCTRL | CBU improvement<br>Blue color sense improvement |
| SDD52 | BCTRL | YCTRL | No | CBU improvement<br>power consumption reduction |
| SDD53 | BCTRL | BCTRL | YCTRL | CBU improvement<br>R/G/Y color sense improvement |
| SDD56 | BCTRL | BCTRL | No | CBU improvement<br>power consumption reduction |
| SDD60 | BCTRL | YCTRL, BCTRL | No | CBU improvement<br>power consumption reduction |
| SDD61 | BCTRL | No | YCTRL | CBU improvement<br>R/G/Y color sense improvement |
| SDD62 | BCTRL | No | BCTRL | CBU improvement<br>B color sense improvement |
| SDD63 | BCTRL | No | YCTRL, BCTRL | CBU improvement<br>R/G/B/Y color sense improvement |
| SDD64 | BCTRL | No | No | CBU improvement |

Figure 16:
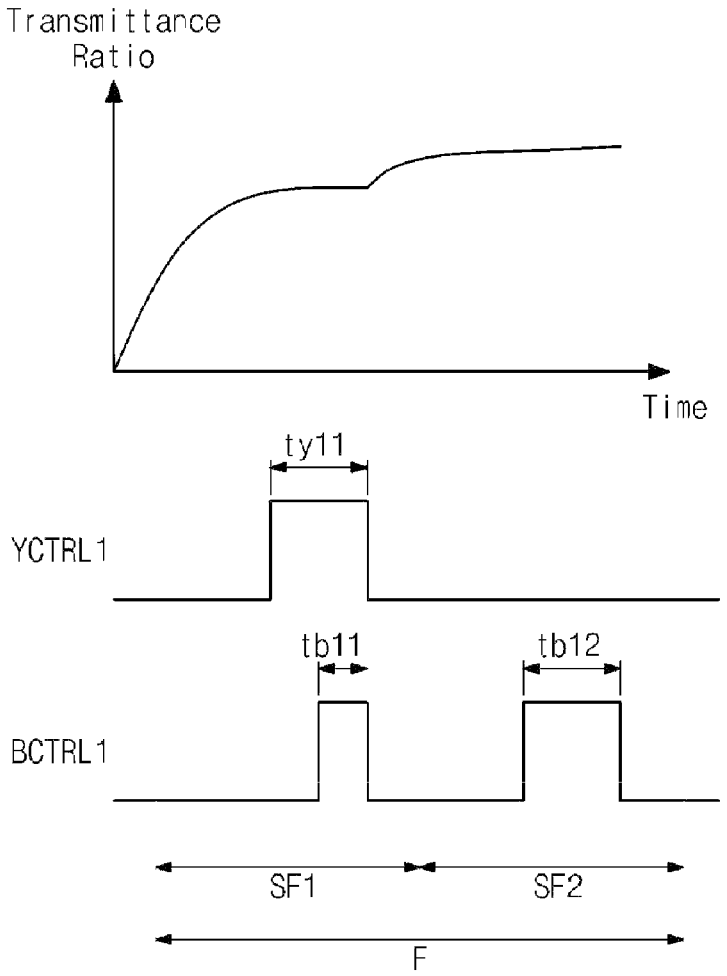

Referring to FIG. 16 and Table 4, when an image type of the image group RGBG1 is one of SDD50 to SDD64, the backlight control signal generator 226 may output a fourth mode of first light control signal YCTRL1 and second light control signal BCTRL1. During the fourth mode, the first light control signal YCTRL1 generated by the backlight control signal generator 226 may be activated within a portion of a period of the first sub frame SF1, and the second light control signal BCTRL1 may be activated within a portion of a period of the first sub frame SF1 and within a portion of a period of a second sub frame SF2. The fourth mode may be a filed split mode where the second light control signal BCTRL1 is divided and activated into the first sub frame SF1 and the second sub frame SF2.

During the fourth mode, the backlight control signal generator 226 may change a width of the active period ty11 of the first light control signal YCTRL1 and the widths of the active periods tb11 and tb12 of the second light control signal BCTRL1, respectively. For example, in the event that the backlight control signal generator 226 shown in FIG. 9 determines an image type of the image group RGBG1 as SDD62, it may maintain the active period ty12 of the first light control signal YCTRL1 with an initial setup time, and may increase the widths of the active periods tb11 and tb12 of the second light control signal BCTRL1.

FIGS. 17 to 21 are diagrams schematically illustrating a crystal transmittance ratio that is varied when pulse widths of first and second light control signals are varied.

Figure 17:
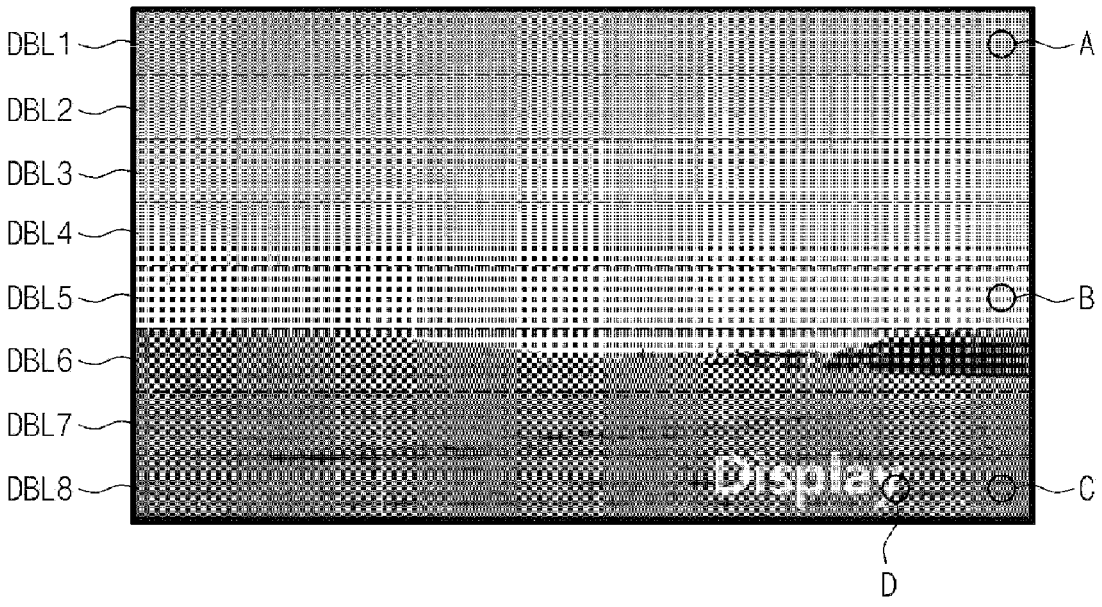
FIGS. 17 to 21 are diagrams schematically illustrating a crystal transmittance ratio which is varied whenever pulse widths of first and second light control signals are varied.
Figure 18:
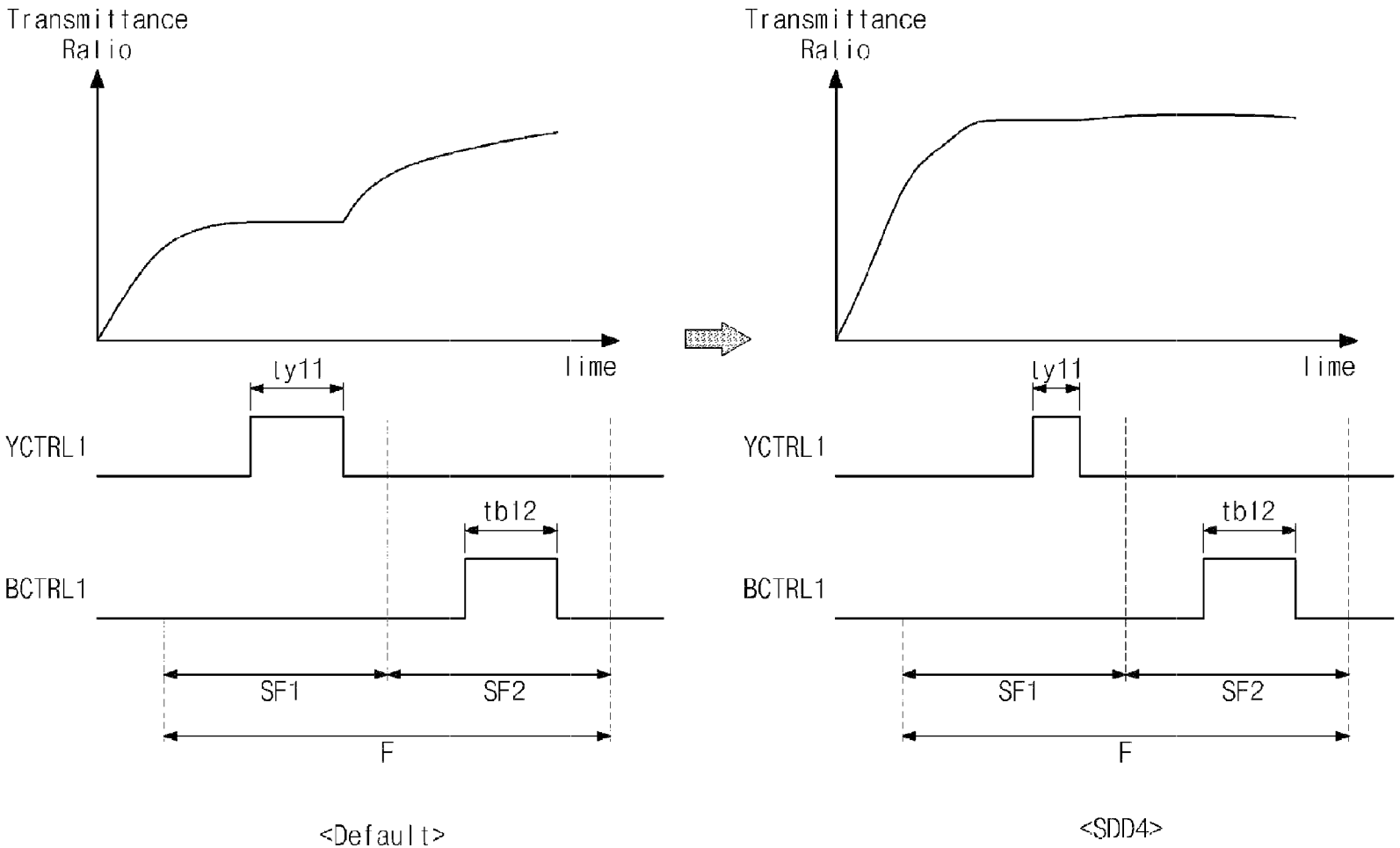
Figure 19:
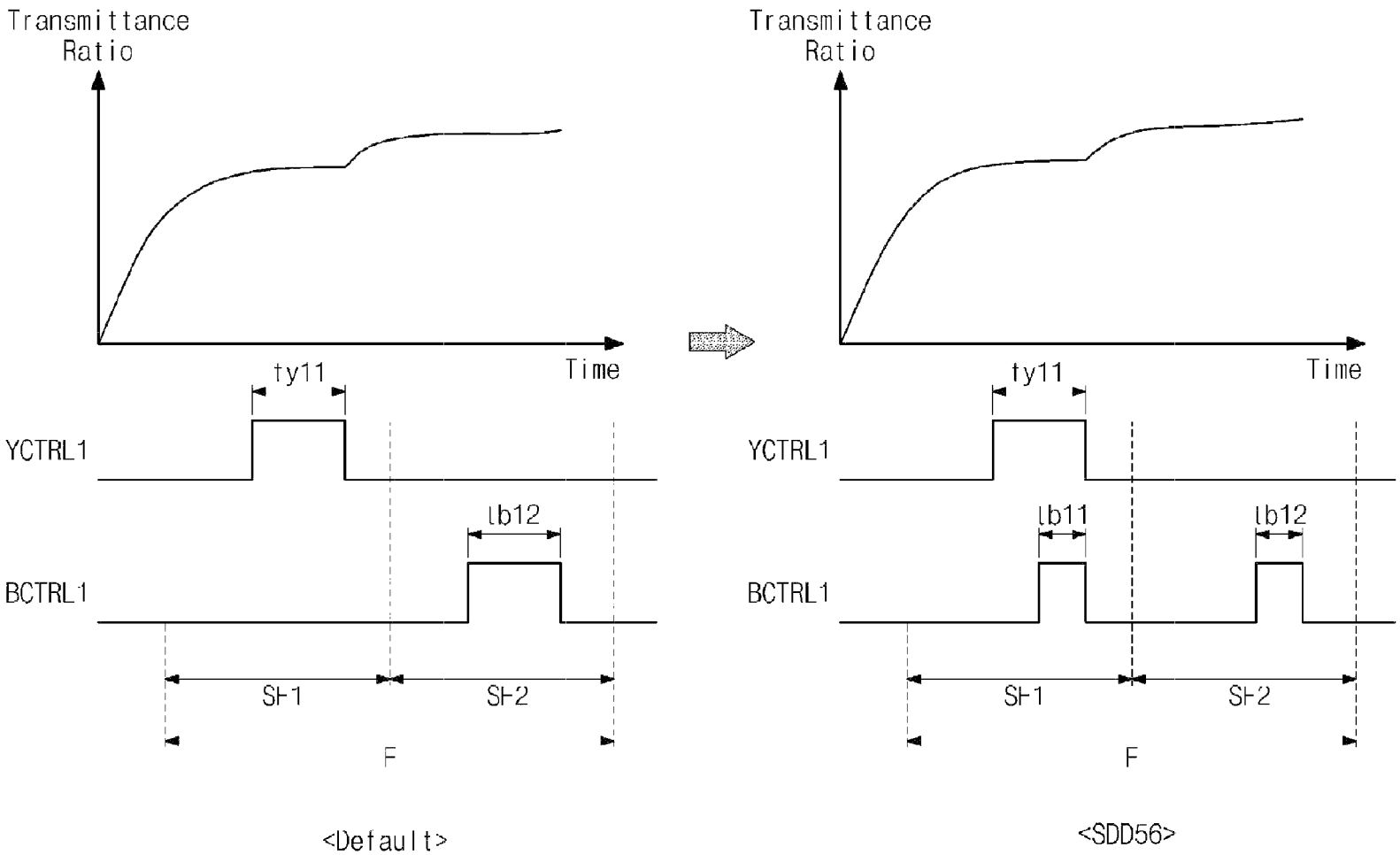
Figure 20:
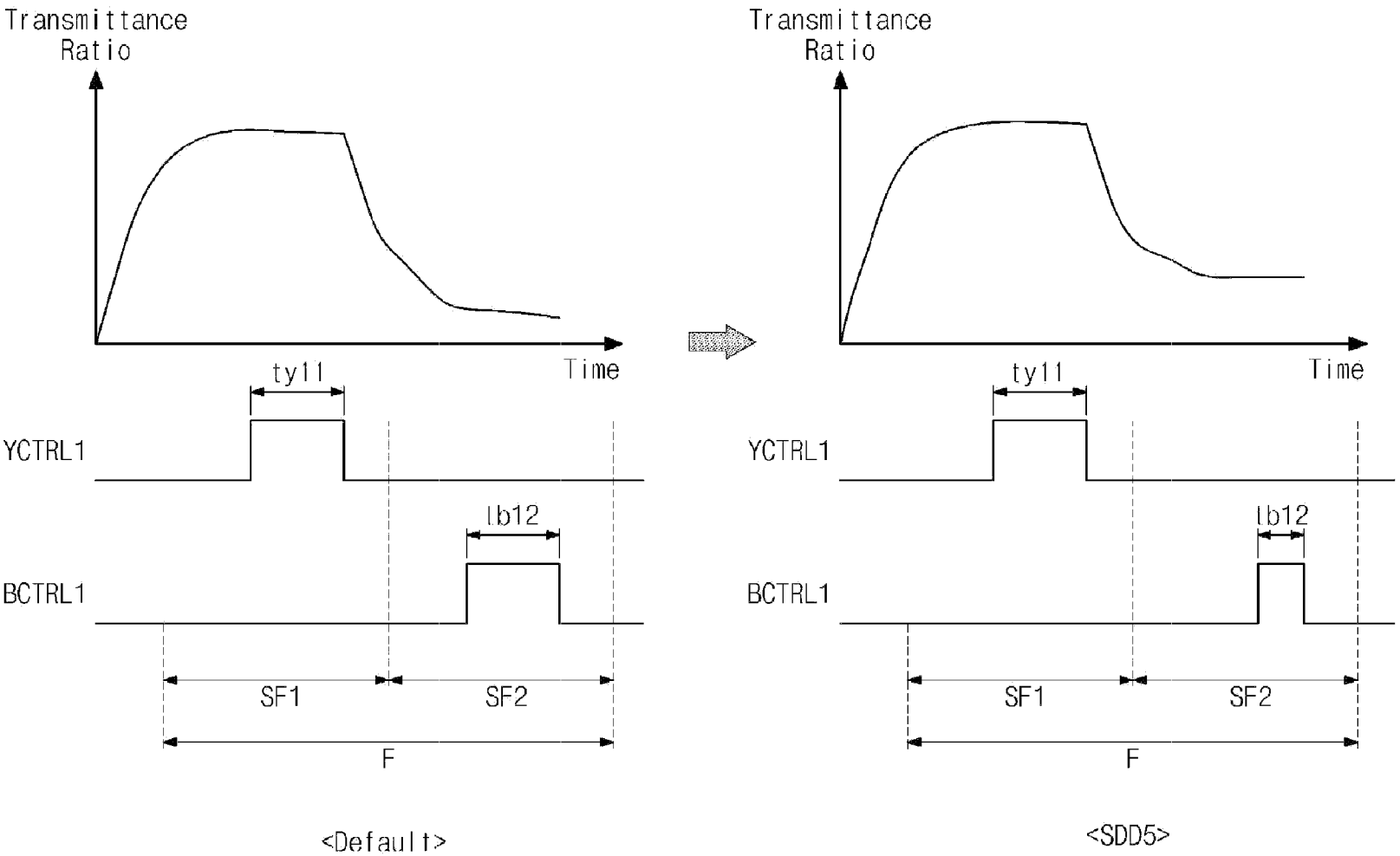
Figure 21:
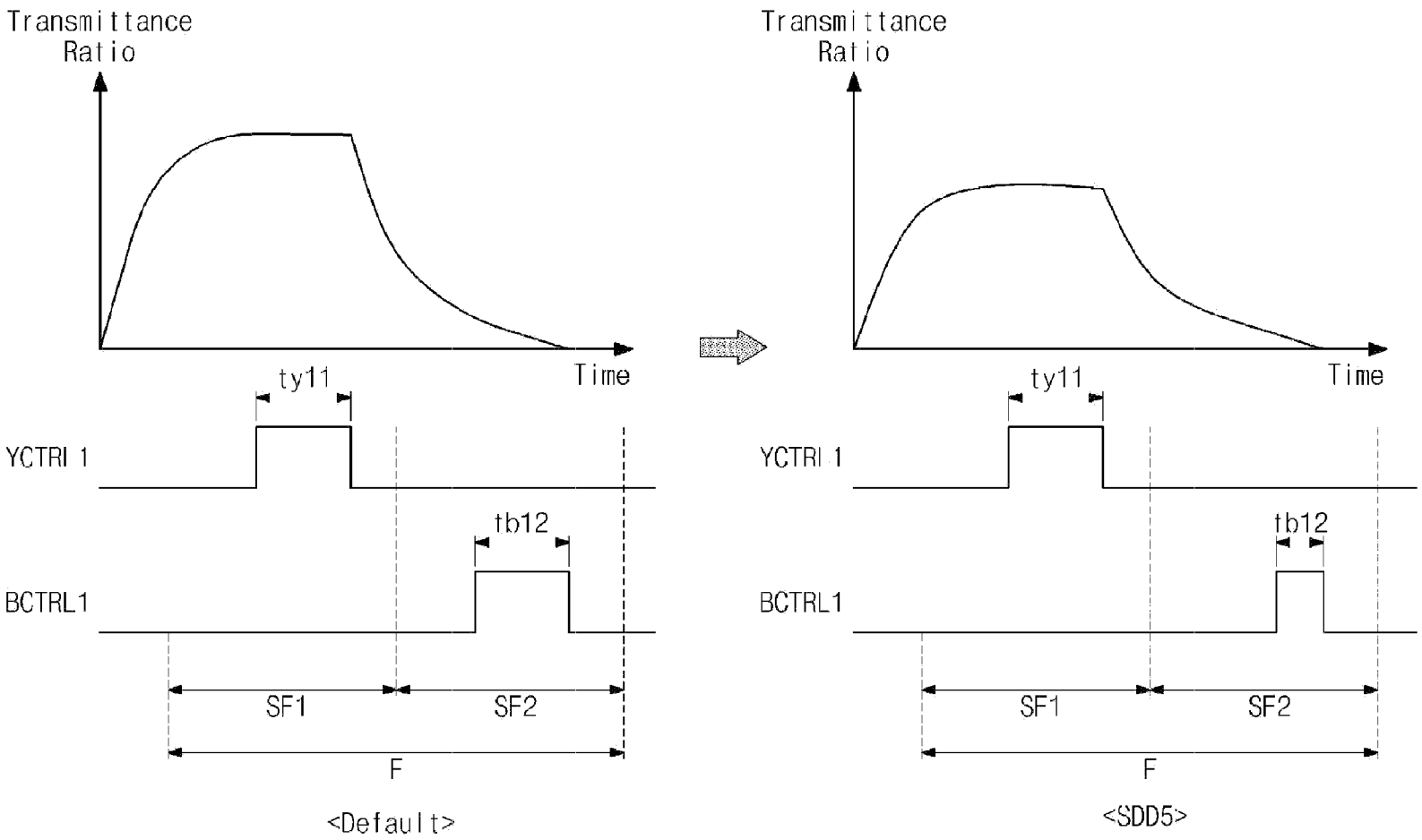

Referring to FIG. 17, a frame of image signal RGB provided from an external device may include a sky expressed by a blue color, a field expressed by a green color, and a letter 'Display' expressed by a yellow color. A variation in a color transmittance ratio of a preselected pixel A of a display block DBK1 when the display panel 110 is divided into eight display blocks DBK1 to DBK8 is illustrated in FIG. 18. A variation in a color transmittance ratio of a preselected pixel B of a display block DBK5 when the display panel 110 is divided into the eight display blocks DBK1 to DBK8 is illustrated in FIG. 19. A variation in a color transmittance ratio of a preselected pixel C of a display block DBK8 when the display panel 110 is divided into the eight display blocks DBK1 to DBK8 is illustrated in FIG. 20. A variation in a color transmittance ratio of a preselected pixel D of the display block DBK8 when the display panel 110 is divided into the eight display blocks DBK1 to DBK8 is illustrated in FIG. 21.

Referring to FIGS. 18 to 21, an active period ty11 of a first light control signal YCTRL1 and an active period tb12 of a second light control signal BCTRL1 may be constant when a backlight control signal generator 226 (refer to FIG. 9) operates in a first mode included in Table 1, at a default state.

As illustrated in FIGS. 17 and 18, because the display block DBK1 expresses a sky having a blue color, a red color, and a green color, an image group RGBG1 may be less than a blue color. The backlight control signal generator 226 may then determine an image type of the image group RGBG1 as 'SDD4' of the first mode in response to a first frequency signal RH, a second frequency signal GH, and a third frequency signal BH from an image analyzer 224.

The first light control signal YCTRL1 generated by the backlight control signal generator 226 may be activated within a portion of a period corresponding to a first sub frame SF1, and the second light control signal BCTRL1 may be activated within a portion of a period corresponding to a second sub frame SF2. The backlight control signal generator 226 may reduce the power consumed by a backlight unit 150 by making the active period ty11 of the first light control signal YCTRL1 become shorter than that of the default state. The backlight control signal generator 226 may output a first luminance compensation signal YC and a second luminance compensation signal BC corresponding to the image type of 'SDD4' thus determined. In exemplary embodiments, the backlight control signal generator 226 may output the first luminance compensation signal YC and the second luminance compensation signal BC to compensate for the active period ty11 of the first light control signal YCTRL1 thus shortened. In response to the first luminance compensation signal YC and the second luminance compensation signal BC from the backlight control unit 220, the luminance compensation unit 210 may output a data signal DATA such that luminance becomes brighter at the first sub frame SF1 and the second sub frame SF2. For example, if the active period ty11 of the first light control signal YCTRL1 is shorter than that of the default state, that is, if a gradation value of the data signal DATA in the first sub frame SF1 being provided to a crystal capacitor CLC (refer to FIG. 1) is set to a maximum value, a blue color of the second sub frame SF2 may be brighter.

As illustrated in FIGS. 17 and 19, a white of the display block BLK5 may be more than that of the display block DBK1. The backlight control signal generator 226 may determine an image type of the image group RGBG1 as 'SDD56' of the fourth mode in response to the first frequency signal RH, the second frequency signal GH, and the third frequency signal BH from the image analyzer 224.

The first light control signal YCTRL1 generated by the backlight control signal generator 226 may be activated within a portion of a period corresponding to the first sub frame SF1, and the second light control signal BCTRL1 may be activated within a portion of a period corresponding to the first sub frame SF1 and within a portion of a period corresponding to the second sub frame SF2. As the second light control signal BCTRL1 is activated with respect to the first sub frame SF1 and the second sub frame SF2, under the control of the backlight control signal generator 226, such that active periods tb11 and tb12 of the second light control signal BCTRL1 are shorter than those of the default state, a color breakup phenomenon may be minimized such that a color of the first sub frame SF1 and a color of the second sub frame SF2 are seen independently.

Referring to FIGS. 17 and 20, green and yellow colors of the display block DBLK8 may be more intense than a blue color thereof. The backlight control signal generator 226 may determine an image type of the image group RGBG1 as 'SDD5' of the first mode in response to the first frequency signal RH, the second frequency signal GH, and the third frequency signal BH from the image analyzer 224.

The first light control signal YCTRL1 generated by the backlight control signal generator 226 may be activated within a portion of a period corresponding to the first sub frame SF1, and the second light control signal BCTRL1 may be activated within a portion of a period corresponding to the second sub frame SF2. The backlight control signal generator 226 may improve a red color and a green color by making the active period ty11 of the first light control signal YCTRL1 become longer than that of the default state, and the active period tb11 of the second light control signal BCTRL1 become shorter than that of the default state. The backlight control signal generator 226 may output the first luminance compensation signal YC and the second luminance compensation signal BC to compensate for the shortened active period tb11 of the second light control signal BCTRL1. In response to the first luminance compensation signal YC and the second luminance compensation signal BC from the backlight control unit 220, the luminance compensation unit 210 may output the data signal DATA such that luminance of the pixel C becomes brighter.

As in FIG. 20, the first light control signal YCTRL1 shown in FIG. 21 may be activated within a portion of a period corresponding to the first sub frame SF1, and the second light control signal BCTRL1 within a portion of a period corresponding to the second sub frame SF2. The backlight control signal generator 226 may make the active period ty11 of the first light control signal YCTRL1 become longer than that of the default state, and the active period tb11 of the second light control signal BCTRL1 become shorter than that of the default state. Thus, the backlight control signal generator 226 may minimize a phenomenon in which a yellow color of a letter 'Display' is mixed with a blue color at the second sub frame SF2.

Figure 22:
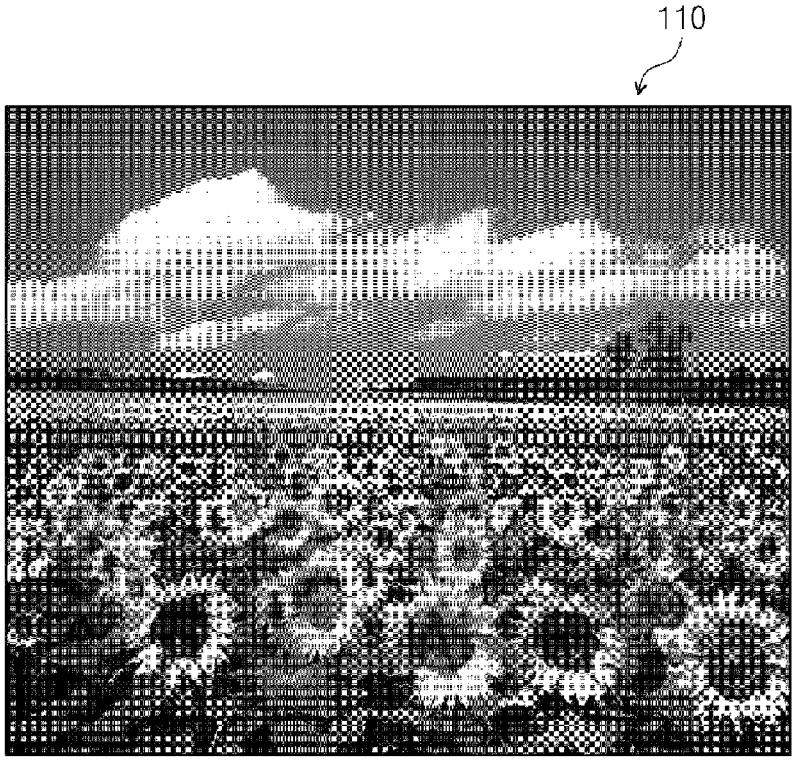
FIG. 22 is a diagram schematically illustrating an image signal of FIG. 10 displayed on a display panel when the timing controller shown in FIG. 1 operates in a first mode at a default state.
Figure 23:
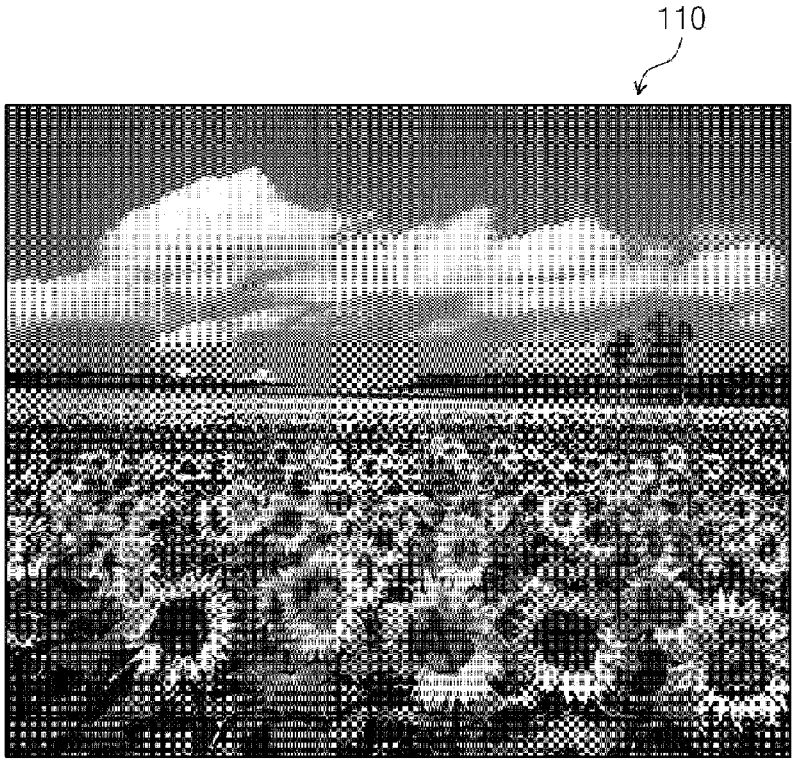
FIG. 23 is a diagram schematically illustrating an image signal of FIG. 10 displayed on a display panel when the timing controller shown in FIG. 1 operates according to an image type of an image signal.

FIG. 22 is a diagram schematically illustrating the image signal of FIG. 10 displayed on the display panel 110, when the timing controller 120 shown in FIG. 1 operates in a default state of a first mode. FIG. 23 is a diagram schematically illustrating the image signal of FIG. 10 displayed on the display panel 110, when the timing controller 120 shown in FIG. 1 operates according to an image type of an image signal.

Figure 24:
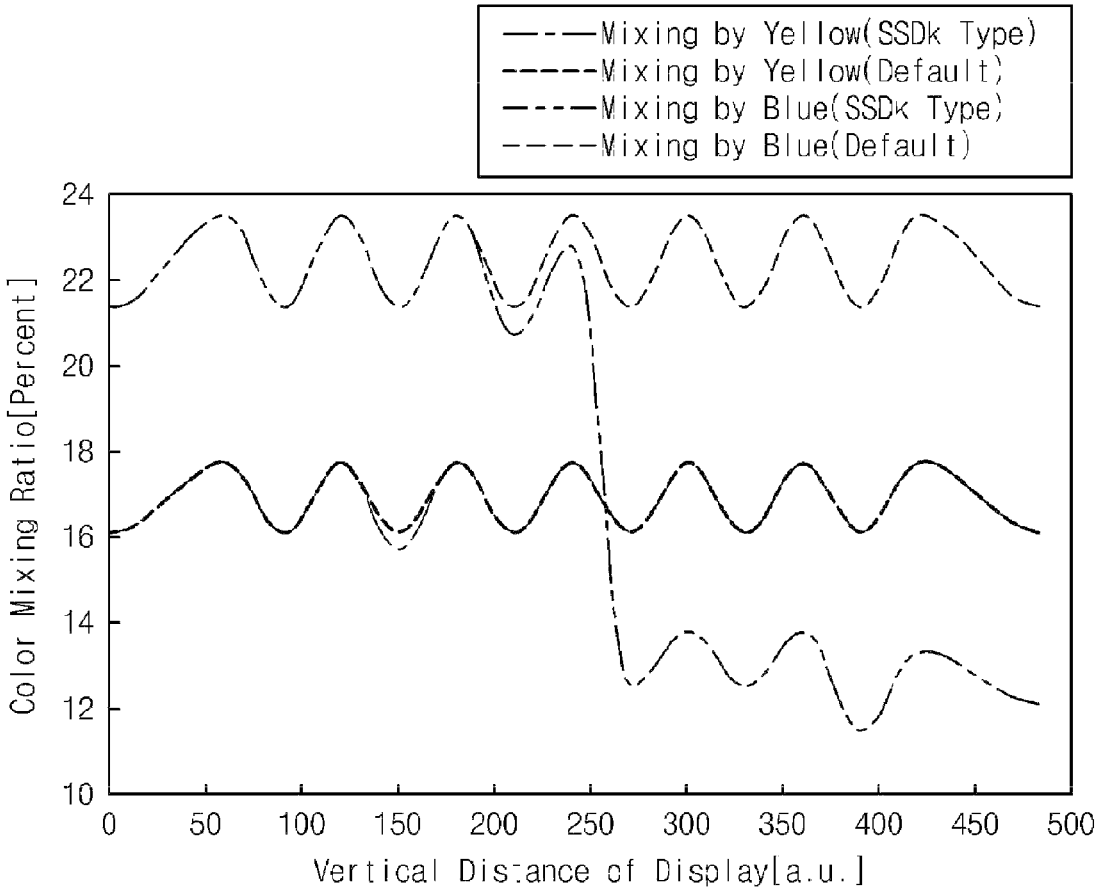
FIG. 24 is a diagram schematically illustrating a mixing ratio of a yellow color and a blue color of an image displayed on a display panel shown in FIGS. 22 and 23 according to an operation state of the timing controller shown in FIG. 1.

FIG. 24 is a diagram schematically illustrating a mixing ratio of a yellow color and a blue color of an image displayed on the display panel 110 shown in FIGS. 22 and 23 according to an operation state of the timing controller 120 shown in FIG. 1. A horizontal axis of a graph shown in FIG. 24 may indicate a second-direction (X2) distance (or, a vertical distance) from a top of the display panel 110, and a vertical axis may indicate a color mixing ratio.

Referring to FIGS. 22 and 24, when the timing controller 120 operates in a default state of a first mode shown in Table 1, first light source control signals YCTRL1 to YCTRL8 and second light source control signals BCTRL1 to BCTRL8 may have active periods ty11 to ty81 and tb12 to tb82, each having a set pulse width (refer to FIG. 7). Therefore, a mixing ratio of a yellow color and a blue color of an image displayed on the display panel 110 may have a constant pattern over the display panel 110.

Referring to FIGS. 23 and 24, when operating according to an image type SDDk of image signal, the timing controller 120 may operate in one of first to fourth modes described above, and the first light source control signals YCTRL1 to YCTRL8 and the second light source control signals BCTRL1 to BCTRL8 may have one of the patterns shown in FIGS. 13 to 16.

As illustrated in FIG. 23, a blue color of sky may be expressed at a top of the display panel 110, and a yellow color of sun flowers may be expressed toward a bottom of the display panel 110, such that an amount of blue color toward the bottom of the display panel 110 may be less than red and green colors. Therefore, under the control of the timing controller 120, the display panel 110 may be driven by a 'SDD12' type of the first mode from a display block DBK5 of the display panel 110. In this case, as illustrated in FIG. 13, the first light source control signals YCTRL1 to YCTRL8 may be activated within a first sub frame SF1, and the second light source control signals BCTRL1 to BCTRL8 may be activated within a second sub frame SF2. Thus, active periods ty11 to ty18 of the first light source control signals YCTRL1 to YCTRL8 and active periods tb12 to tb82 of the second light source control signals BCTRL1 to BCTRL8 are reduced as compared with a default state. If the active periods ty11 to ty18 of the first light source control signals YCTRL1 to YCTRL8, and the active periods tb12 to tb82 of the second light source control signals BCTRL1 to BCTRL8 are reduced in duration, turn-on time periods of first and second light sources 151 and 156 may be decreased. This may mean that power consumption of a 'SDD12' type is reduced by about 14% as compared with the default state. As illustrated in FIG. 24, there may be remarkably reduced a color mixing phenomenon of a blue color at the bottom of the display panel 110 where sun flowers are expressed.

Figure 25:
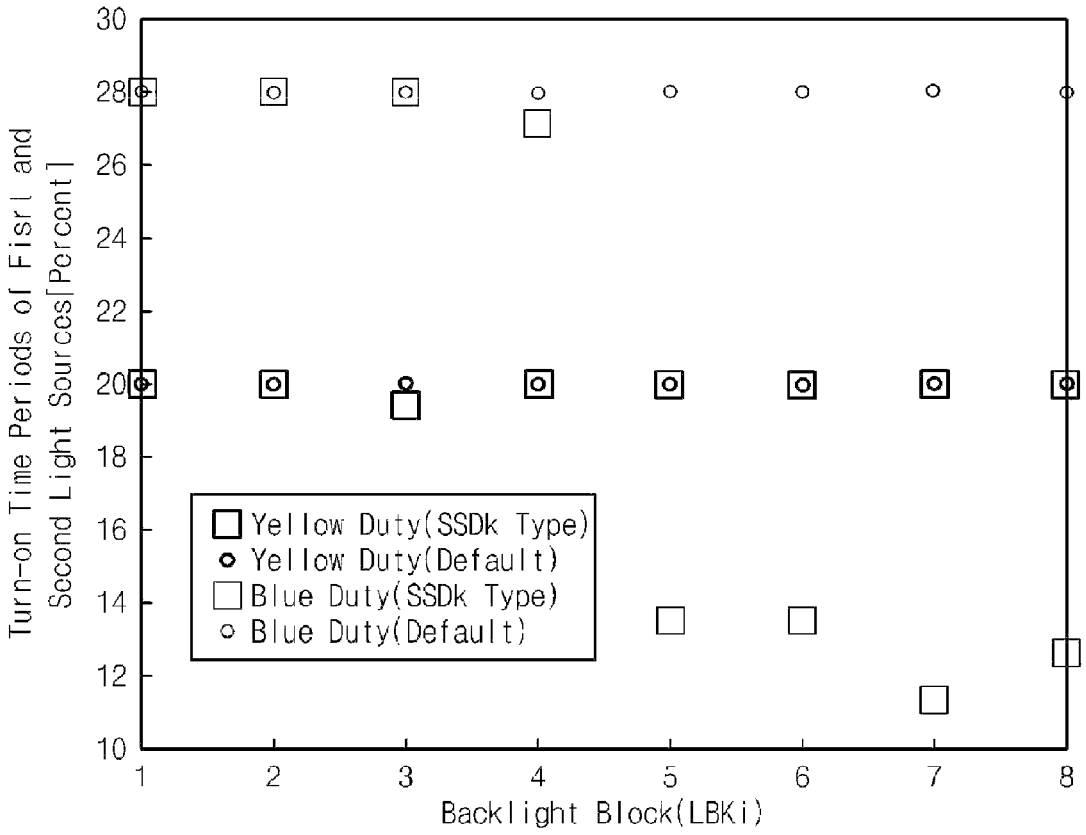
FIG. 25 is a diagram schematically illustrating turn-on time periods, expressed as LED duty cycle, of first and second light sources when an image illustrated in FIGS. 22 and 23 is displayed on a display pane according to an operation state of the timing controller shown in FIG. 1.

FIG. 25 is a diagram schematically illustrating turn-on time periods of first and second light sources when an image illustrated in FIGS. 22 and 23 is displayed on a display pane according to an operation state of the timing controller 120 shown in FIG. 1. In FIG. 25, a horizontal axis may indicate light source blocks LBKi (i=1, 2, . . . , 8), and a vertical axis may indicate turn-on time periods of first and second light sources 151 and 152 (refer to FIG. 6).

Referring to FIGS. 22 and 25, when the timing controller 120 operates in a default state of a first mode shown in Table 1, first light source control signals YCTRL1 to YCTRL8 and second light source control signals BCTRL1 to BCTRL8 may have active periods ty11 to ty81 and tb12 to tb82, each having a preset pulse width (refer to FIG. 7). Therefore, turn-on time periods of first and second light sources 151 and 152 in light source blocks LB1 to LBK8 may be constantly maintained.

Referring to FIGS. 23 and 25, when operating according to an image type SDDk of image signal, the timing controller 120 may operate in one of first to fourth modes described above, and the first light source control signals YCTRL1 to YCTRL8 and the second light source control signals BCTRL1 to BCTRL8 may have one of patterns shown in FIGS. 13 to 16. For example, in the event that the display panel 110 is driven by a 'SDD12' type of the first mode from a display block DBK5 of the display panel 110 under the control of the timing controller 120, there may be a remarkably reduced turn-on time period of a second light source 152 providing a blue color light.

Figure 26:
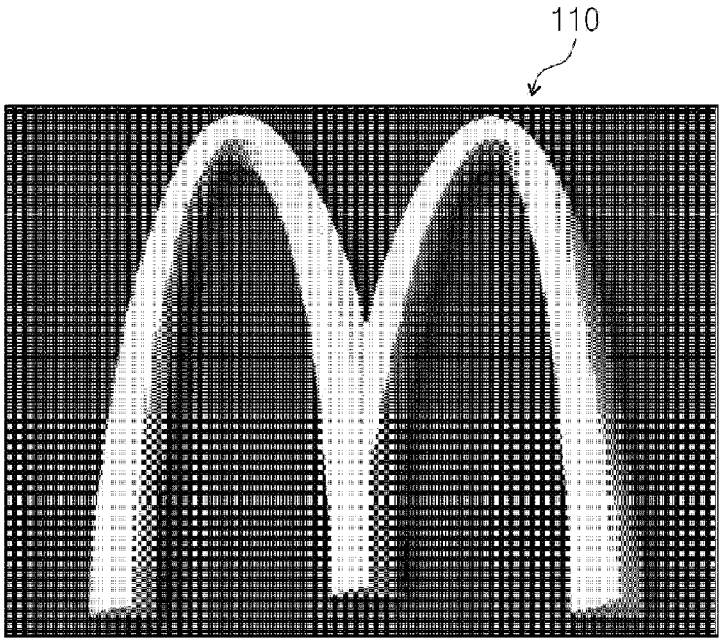
FIG. 26 is a diagram schematically illustrating an image signal (including a red color and a yellow color) displayed on a display panel when the timing controller shown in FIG. 1 operates in a first mode at a default state.
Figure 27:
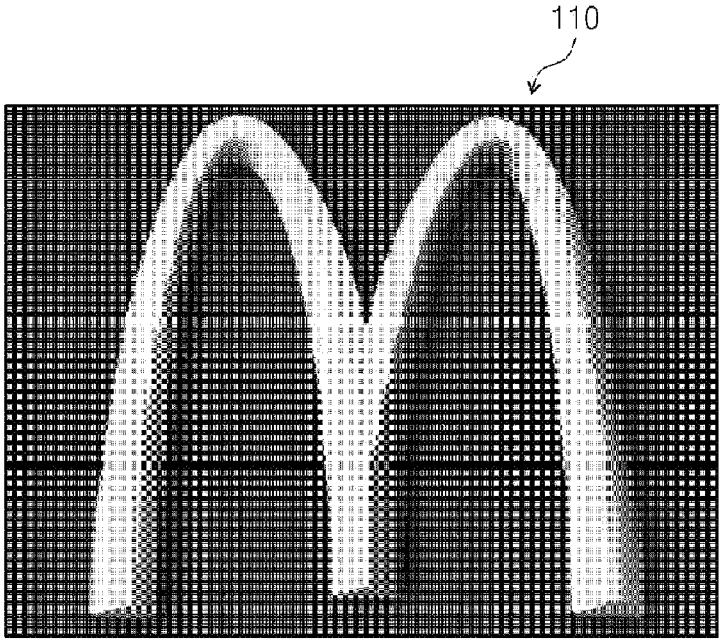
FIG. 27 is a diagram schematically illustrating an image signal (including a red color and a yellow color) displayed on a display panel when the timing controller shown in FIG. 1 operates according to an image type of an image signal.

FIG. 26 is a diagram schematically illustrating an image signal (including a red color and a yellow color) displayed on the display panel 110 when the timing controller 120 shown in FIG. 1 operates in a default state of a first mode. FIG. 27 is a diagram schematically illustrating an image signal (including a red color and a yellow color) displayed on the display panel 110 when the timing controller 120 shown in FIG. 1 operates according to an image type of an image signal.

Figure 28:
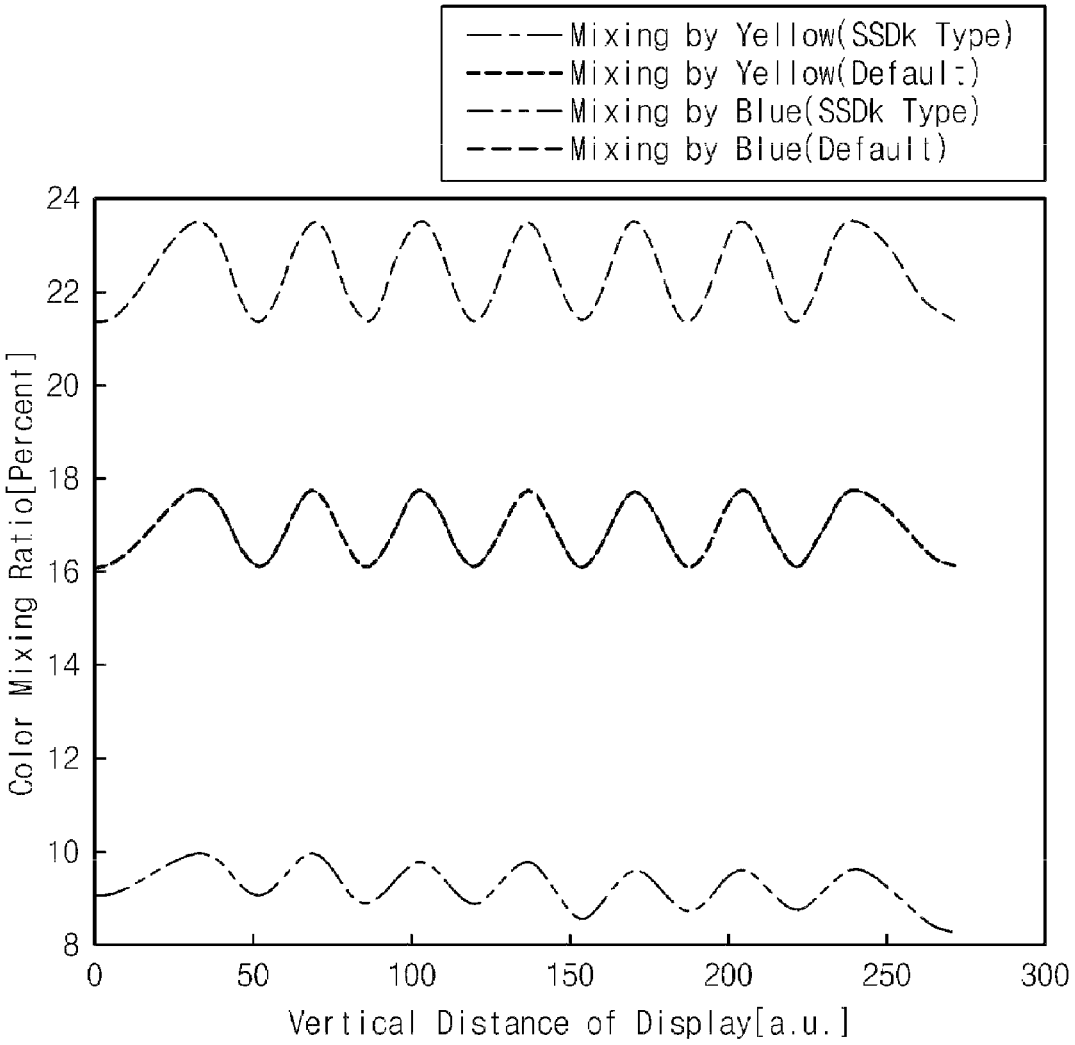
FIG. 28 is a diagram schematically illustrating a mixing ratio of a yellow color and a blue color of an image displayed on a display panel shown in FIGS. 26 and 27 according to an operation state of the timing controller shown in FIG. 1.

FIG. 28 is a diagram schematically illustrating a mixing ratio of a yellow color and a blue color of an image displayed on the display panel 110 shown in FIGS. 26 and 27 according to an operation state of the timing controller 120 shown in FIG. 1. A horizontal axis of a graph shown in FIG. 28 may indicate a second-direction (X2) distance (or, a vertical distance) from a top of the display panel 110, and a vertical axis may indicate a color mixing ratio.

Referring to FIGS. 26 and 28, when the timing controller 120 operates in a default state of a first mode shown in the table 1, first light source control signals YCTRL1 to YCTRL8 and second light source control signals BCTRL1 to BCTRL8 may have active periods ty11 to ty81 and tb12 to tb82, each having a preset pulse width (refer to FIG. 7). Therefore, a mixing ratio of a yellow color and a blue color of an image displayed on the display panel 110 may have a constant pattern over the display panel 110.

Referring to FIGS. 27 and 28, when operating according to an image type SDDk of image signal, the timing controller 120 may operate in one of first to fourth modes described above, and the first light source control signals YCTRL1 to YCTRL8 and the second light source control signals BCTRL1 to BCTRL8 may have one of the patterns shown in FIGS. 13 to 16.

As illustrated in FIG. 27, an image expressed over the display panel 110 may include a wallpaper of a red color and a character 'M' expressed by a yellow color. That is, because an image expressed on the display panel 110 does not include a blue color, display blocks DBK1 to DBK8 DBK1 of the display panel 110 all may be driven by a 'SDD8' type of the first mode under the control of the timing controller 120. If the active periods tb12 to tb82 of the second light source control signals BCTRL1 to BCTRL8 are reduced in duration, a turn-on time period of the second light sources 152 is also reduced (refer to FIG. 6). Thus, power consumption of a 'SDD8' type may be reduced by about 40% as compared with the default state. As illustrated in FIG. 26, there may be a remarkably reduced color mixing phenomenon of a blue color is mixed with a red color and a yellow color.

Figure 29:
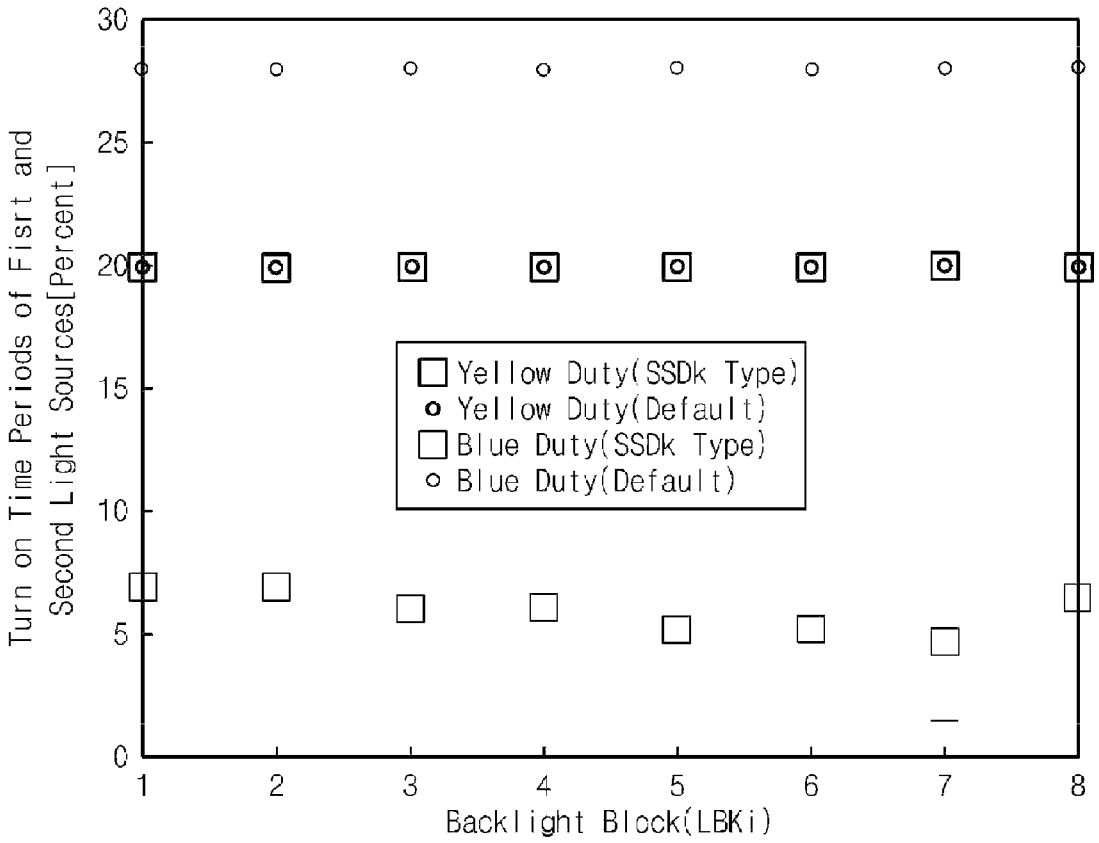
FIG. 29 is a diagram schematically illustrating turn-on time periods, expressed as LED duty cycle, of first and second light sources when an image illustrated in FIGS. 26 and 27 is displayed on a display pane according to an operation state of the timing controller shown in FIG. 1.

FIG. 29 is a diagram schematically illustrating turn-on time periods of first and second light sources 151, 152 when an image illustrated in FIGS. 26 and 27 is displayed on a display pane according to an operation state of the timing controller 120 shown in FIG. 1. In FIG. 29, a horizontal axis may indicate light source blocks LBKi (i=1, 2, . . . , 8), and a vertical axis may indicate turn-on time periods of first and second light sources 151 and 152 (refer to FIG. 6).

Referring to FIGS. 26 and 29, when the timing controller 120 operates in a default state of a first mode shown in Table 1, first light source control signals YCTRL1 to YCTRL8 and second light source control signals BCTRL1 to BCTRL8 may have active periods ty11 to ty81 and tb12 to tb82, each having a preset pulse width (refer to FIG. 7). Therefore, turn-on time periods of first and second light sources 151 and 152 in light source blocks LB1 to LBK8 may be constantly maintained.

Referring to FIGS. 27 and 29, when operating according to an image type SDDk of image signal, the timing controller 120 may operate in one of first to fourth modes described above, and the first light source control signals YCTRL1 to YCTRL8 and the second light source control signals BCTRL1 to BCTRL8 may have one of the patterns shown in FIGS. 13 to 16. For example, in the event that display blocks DBK1 to DBK8 DBK1 to DBK8 of the display panel 110 all are driven by a 'SDD8' type under the control of the timing controller 120, there may be a remarkably reduced turn-on time of a second light source 152 providing a blue color light.

Figure 30:
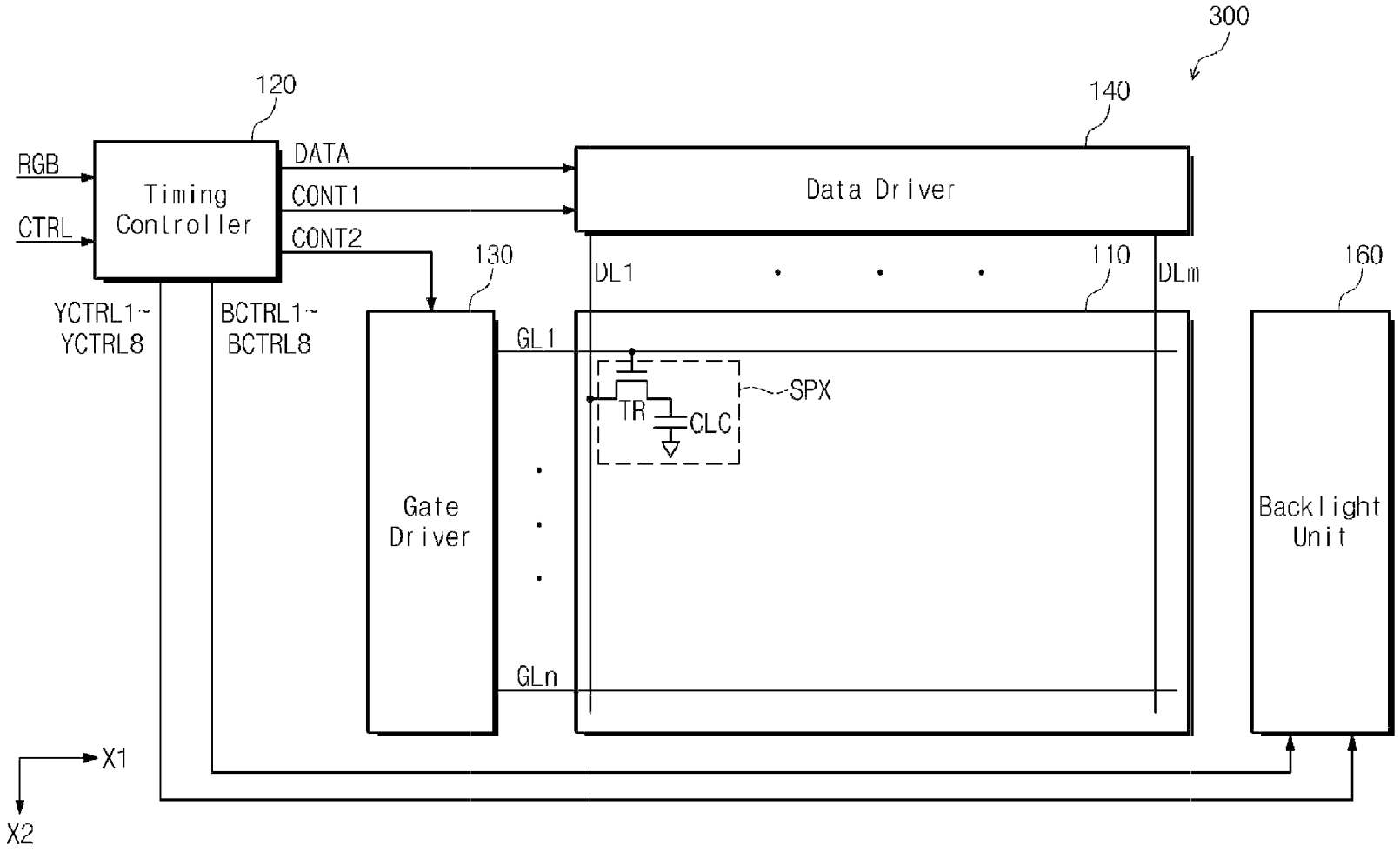
FIG. 30 is a block diagram schematically illustrating a display device according to an exemplary embodiment of the present invention.

FIG. 30 is a block diagram schematically illustrating a display device according to an exemplary embodiment of the present invention. In FIG. 30, constituent elements that are the same as those in FIG. 1 may be represented by the same reference numerals, and a description thereof is thus omitted.

Referring to FIG. 30, a display device may comprise the display panel 110, the timing controller 120, a gate driver 130, the data driver 140, and a backlight unit 160. The timing controller 120, the gate driver 130, and the data driver 140 may constitute a display panel driving unit that drives the display panel 110.

The backlight unit 150 shown in FIG. 1 may be a direct type of backlight that is disposed at the rear of the display panel 110 and supplies a light to the display panel 110. The backlight unit 150 shown in FIG. 3 may be an edge type of backlight that is disposed at one edge of the display panel 110 and supplies a light to the display panel 110. The backlight unit 160 may be disposed to be adjacent to one of a long edge and a short edge of the display panel 110. Alternatively, the backlight unit 160 may be respectively disposed at two long edges of the display panel 110 with the display panel 110 interposed therebetween, or may be respectively disposed at two short edges of the display panel 110 with the display panel 110 interposed therebetween.

Figure 31:
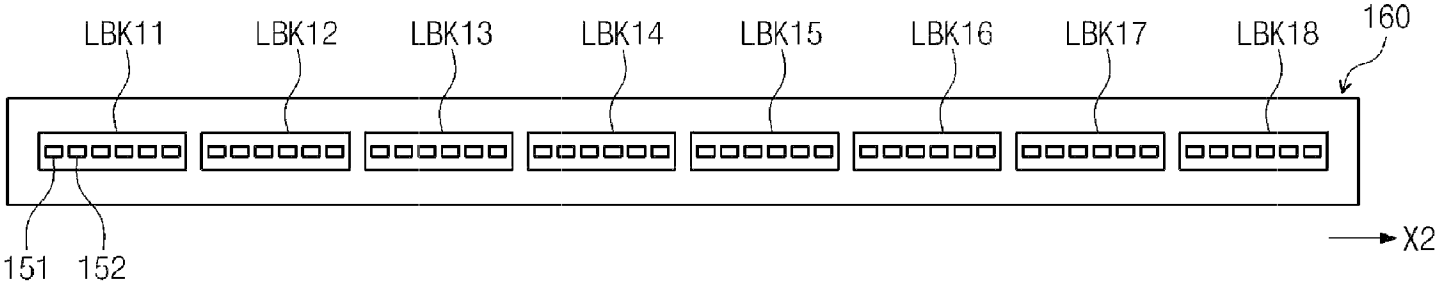
FIG. 31 is a diagram schematically illustrating an arrangement of light sources of the backlight unit shown in FIG. 30.

FIG. 31 is a diagram schematically illustrating an arrangement of light sources of the backlight unit 160 shown in FIG. 30.

Referring to FIG. 31, a backlight unit 160 may include light source blocks LBK11 to LBK18 LBK11 to LBK18 respectively corresponding to display blocks DBK1 to DBK8 (refer to FIG. 3) of the display panel 110. Each of the light source blocks LBK11 to LBK18 may include the first light sources 151 and the second light sources 152. As described with reference to FIG. 2, the first light sources 151 may provide a first color light, and the second light sources 152 may provide a second color light. The first light sources 151 and the second light sources 152 may be sequentially and alternately disposed along a second direction X2. FIG. 31 illustrates an exemplary embodiment in which the first light sources 151 and the second light sources 152 are arranged in line. However, the present invention is not limited thereto. For example, the first light sources 151 and the second light sources 152 may be arranged in two or more lines.

Figure 32:
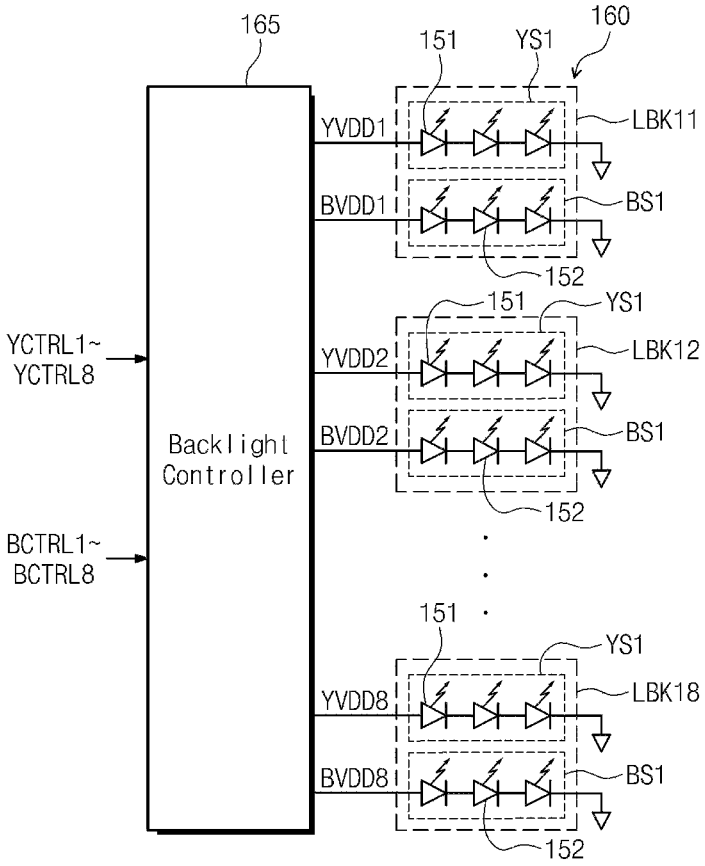
FIG. 32 is a block diagram schematically illustrating the backlight unit shown in FIG. 30.

FIG. 32 is a block diagram schematically illustrating the backlight unit 160 shown in FIG. 30.

Referring to FIG. 32, a backlight unit 160 may include the backlight controller 165 and light source blocks LBK11 to LBK18. The backlight controller 165 may receive first light source control signals YCTRL1 to YCTRL8 and second light source control signals BCTRL1 to BCTRL8 from the timing controller 120 shown in FIG. 1 to generate first light source voltages YVDD1 to YVDD8 and second light source voltages BVDD1 to BVDD8 that supply power to light source blocks LBK11 to LBK18.

Each of the light source blocks LBK11 to LBK18 may include a first light source string YS1 including first light sources 151 connected in series and a second light source string BS1 including second light sources 152 connected in series.

First light source strings YS1 in the light source blocks LBK11 to LBK18 may be supplied with first light source voltages YVDD1 to YVDD8 from the backlight controller 165, and second light source strings BS1 in the light source blocks LBK11 to LBK18 may be supplied with second light source voltage BVDD1 to BVDD8 from the backlight controller 165.

The timing controller 120 shown in FIG. 30 may generate the first light source control signals YCTRL1 to YCTRL8 and the second light source control signals BCTRL1 to BCTRL8 according to the same scheme as described with reference to Tables 1 to 4 and timing diagrams shown in FIGS. 6 and 13 to 16, and may provide them to the backlight controller 165.

Figure 33:
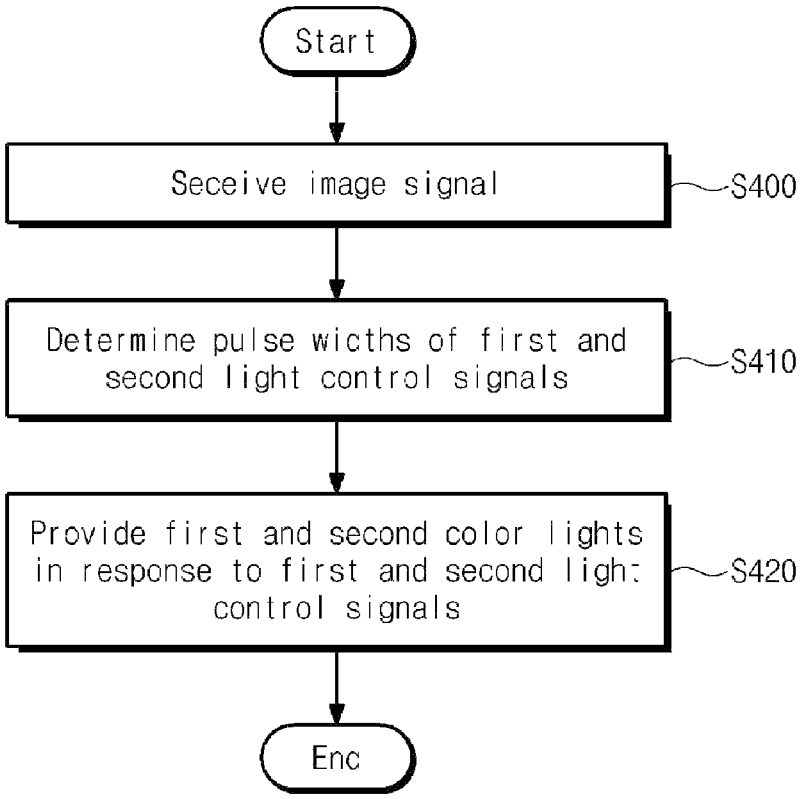
FIG. 33 is a flow chart for describing a driving method of a display device according to an exemplary embodiment of the present invention.

FIG. 33 is a flow chart for describing a driving method of a display device according to an exemplary embodiment of the present invention. For ease of description, a driving method of a display device will be described with reference to the display device 100 shown in FIG. 1 and a timing controller 120 shown in FIG. 8.

In step S440, referring to FIGS. 8 and 33, the timing controller 120 may receive an image signal RGB.

In step S410, a backlight control unit 220 may determine pulse widths of first light source control signals YCLTRL1 to YCTRL8 and second light source control signals BCTRL1 to BCTRL8 according to a color characteristic of an image signal RGG. In step S420, a backlight unit 150 (refer to FIG. 1) may provide a first color light and a second color light during times respectively corresponding to the first light source control signals YCLTRL1 to YCTRL8 and the second light source control signals BCTRL1 to BCTRL8.

Figure 34:
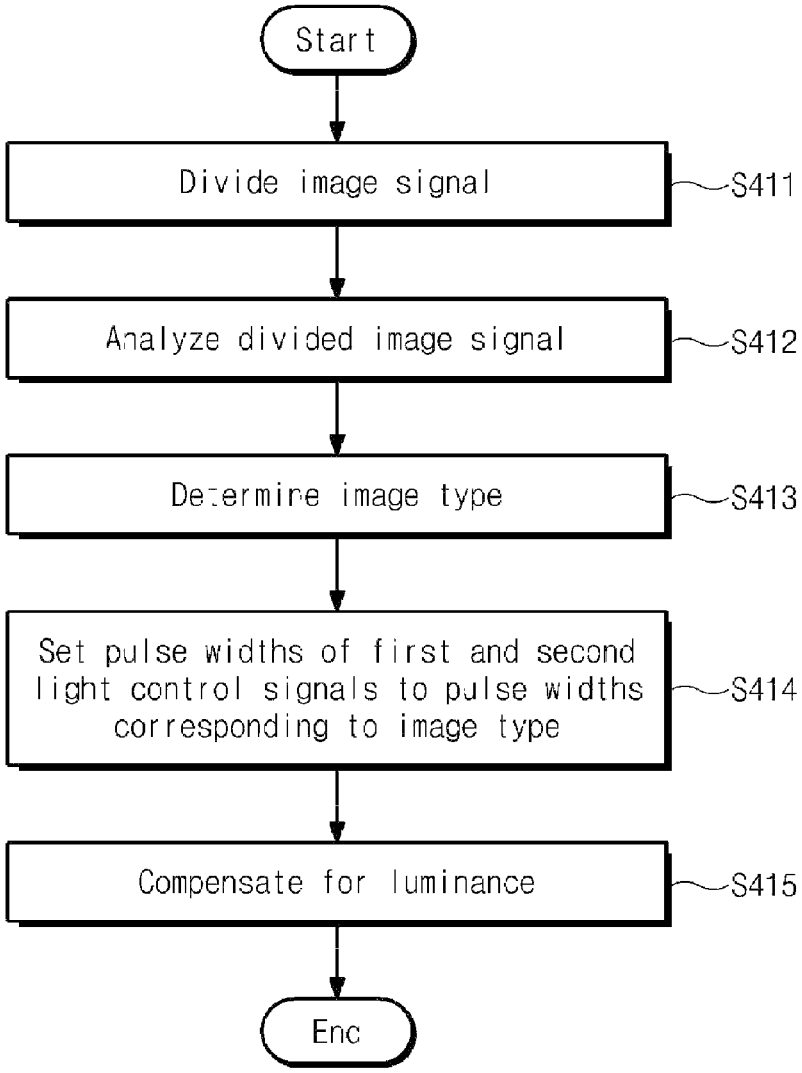
FIG. 34 is a flow chart for describing a method of deciding a pulse width of each of first light source control signals and second light source control signals shown in FIG. 33.

FIG. 34 is a flow chart for describing a method of deciding a pulse width of each of first light source control signals and second light source control signals shown in FIG. 33. For ease of description, a driving method of a display device will be described with reference to the display device 100 shown in FIG. 1 and the timing controller 120 shown in FIG. 8.

Referring to FIGS. 9 and 34, to determine a pulse width of each of first light source control signals and second light source control signals, in step S411, an image splitter 222 may divide an image signal RGB into image groups RGBG1 to RGBG8 respectively corresponding to display blocks DBK1 to DKB8 (refer to FIG. 3).

In step S412, the image analyzer 224 may analyze color characteristics of the image groups RGBG1 to RGBG8 to output first to third frequency signals RH, GH, and BH. After sequentially analyzing color characteristics of the image groups RGBG1 to RGBG8, the image analyzer 224 may output the first to third frequency signals RH, GH, and BH corresponding to a color characteristic of the image group RGBG1, and may output the first to third frequency signals RH, GH, and BH corresponding to a color characteristic of the image group RGBG2. First to third frequency signals RH, GH, and BH corresponding to a color characteristic of each of the image groups RGBG1 to RGBG8 may be generated in the same manner as described above.

In step S413, a backlight control signal generator 226 may determine an image type of each of the image groups RGBG1 to RGBG8 based on the first to third frequency signals RH, GH, and BH. In step S414, the backlight control signal generator 226 may set a pulse width of each of first light source control signals YCLTRL1 to YCTRL8 and the second light source control signals BCTRL1 to BCTRL8 to a pulse width corresponding to the determined image type.

The backlight control signal generator 226 may output a first luminance compensation signal YC and a second luminance compensation signal BC corresponding to the decoded image type. A luminance compensation unit 210 (refer to FIG. 8) may output a data signal DATA obtained by compensating for luminance of the image signal RGB in response to the first luminance compensation signal YC and the second luminance compensation signal BC.

The exemplary embodiments of the present invention make it possible to realize full color on a display panel using a time/space division scheme. Also, the exemplary embodiments of the present invention permit adjustment of turn-on times of first and second light sources of a backlight unit according to a color characteristic of an image being displayed. In particular, the display panel may be divided into a plurality of display blocks, and the backlight unit may be divided into a plurality of light source blocks to correspond to the plurality of display blocks. The turn-on times of the first and second light sources in a light source block may be adjusted according to a color characteristic of an image being displayed within each display block. Thus, the quality of an image being displayed on a display panel may be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel;

a display panel driving unit configured to convert an image signal provided from an external device into a data signal such that an image is displayed on the display panel and to output a first light control signal and a second light control signal; and a backlight unit configured to provide the display panel with a first color light and a different second color light in response to the first light control signal and the second light control signal, wherein:

the display panel driving unit is further configured to determine a pulse width of each of the first light control signal and the second light control signal according to a color characteristic of the image signal;

the backlight unit comprises first and second light sources, each of the first and second light sources being configured to provide one color light from the group consisting of the first color light and the second color light;

each of the first light source and the second light source consists of a single LED;

the first color light is a yellow light and the second color light is a blue light;

the display panel is configured to display an image by a frame unit;

the display panel driving unit is configured to output the first light control signal and the second light control signal such that the first color light and the different second color light are emitted independently at a first sub frame and a second sub frame, obtained by dividing the frame unit on a time basis; and the display panel driving unit is configured to operate in one of first to fourth modes according to a color characteristic of the image signal such that the first color light is emitted in the first sub frame in all of the modes, the second color light is emitted in the second sub frame in all of the modes, and at least one of the first color light and the second color light is emitted in both of the first and second sub frames in all except one of the modes.

2. The display device of claim 1, wherein:

the display panel comprises a plurality of display blocks and the backlight unit comprises a plurality of light source blocks respectively corresponding to the plurality of display blocks; and each of the light source blocks comprises the first light source providing the first color light and the second light source providing the second color light.

3. The display device of claim 2, wherein the display panel driving unit is configured to output a plurality of first light source control signals and a plurality of second light source control signals respectively corresponding to the plurality of light source blocks.

4. The display device of claim 3, wherein:

the first light source of each of the light source blocks is turned on during a time period corresponding to a pulse width of a corresponding one of the first light source control signals to emit the first color light; and the second light source of each of the light source blocks is turned on during a time period corresponding to a pulse width of a corresponding one of the second light source control signals to emit the second color light.

5. The display device of claim 4, wherein, during a first mode, the display panel driving unit outputs the first light control signals and the second light source control signals such that:

the first light source of each of the light source blocks is turned on within the first sub frame; and the second light source of each of the light source blocks is turned on within the second sub frame.

6. The display device of claim 4, wherein, during a second mode, the display panel driving unit outputs the first light control signals such that the first light source of each of the light source blocks is respectively turned on within the first sub frame and within the second sub frame, and outputs the second light source control signals such that the second light source of each of the light source blocks is respectively turned on within the first sub frame and within the second sub frame.

7. The display device of claim 4, wherein, during a third mode, the display panel driving unit outputs the first light control signals such that the first light source of each of the light source blocks is respectively turned on within the first sub frame and within the second sub frame, and outputs the second light source control signals such that the second light source of each of the light source blocks is turned on within the second sub frame.

8. The display device of claim 4, wherein, during a fourth mode, the display panel driving unit outputs the first light control signals such that the first light source of each of the light source blocks is turned on within the first sub frame, and outputs the second light source control signals such that the second light source of each of the light source blocks is respectively turned on within the first sub frame and within the second sub frame.

9. The display device of claim 4, wherein:

the image signal comprises a red color signal, a green color signal, and a blue color signal; and the display panel driving unit is configured to determine a pulse width of each of the first light source control signals and the second light source control signals according to signal levels corresponding to the red color, the green color, and the blue color included in the image signal being displayed by the display blocks.

10. The display device of claim 3, further comprising sub pixels connected to gate lines and data lines, wherein the display panel driving unit comprises:

a gate driver configured to drive the gate lines;

a data driver configured to drive the data lines; and a timing controller configured to control the gate driver and the data driver and to output the first light source control signals and the second light source control signals, each having a pulse width set according to the color characteristic of the image signal from the external device.

11. The display device of claim 10, wherein:

the timing controller comprises:

a backlight control unit configured to output the first light source control signals and the second light source control signals, each having a pulse width set according to the color characteristic of the image signal and a first luminance compensation signal and a second luminance compensation signal; and a luminance compensation unit configured to convert the image signal into a data signal to provide the data signal to the data driver;

wherein the data signal is obtained by compensating for luminance of the image signal based on the first luminance compensation signal and the second luminance compensation signal.

12. The display device of claim 11, wherein the backlight control unit comprises:

an image splitter configured to divide the image signal into a plurality of image groups respectively corresponding to the plurality of display blocks;

an image analyzer configured to analyze a color characteristic of each of the image groups to output first to third frequency signals; and a backlight control signal generator configured to determine an image type of each of the image groups in response to the first to third frequency signals and to output the first light source control signals and the second light source control signals, each having a pulse width set according to the determined image type, the first luminance compensation signal, and the second luminance compensation signal.

13. The display device of claim 1, wherein the display panel comprises:

sub pixels; and a first color filter, a second color filter, and an open portion sequentially arranged in a first direction to correspond to each of the sub pixels in a one-to-one relationship.

14. The display device of claim 13, wherein the first color filter is a red color filter, and the second color filter is a green color filter.

15. The display device of claim 1, wherein the backlight unit comprises direct-type light emitting diodes arranged in a matrix and disposed at the rear of the display panel.

16. The display device of claim 1, wherein the backlight unit comprises edge-type light emitting diodes arranged at one side of the display panel in a stripe shape.

17. A method of driving a display device, comprising:

receiving an image signal;

determining a pulse width of each of first light source control signals and second light source control signals according to a color characteristic of the image signal;

providing a first color light from a first light source and a second color light from a second light source during a time period corresponding to a pulse width of each of the first light source control signals and the second light source control signals, each of the first and second light sources providing one color light from the group consisting of the first color light and the second color light; and providing the image signal to a display panel, the image signal to be displayed by a frame unit, wherein:

each of the first light source and the second light source consists of a single LED;

the first color light is a yellow light and the second color light is a blue light;

the providing a first color light and a second color light comprises providing the first light source control signals and the second light source control signals such that the first color light and the second color light are emitted independently during each of a first sub frame and a second sub frame obtained by dividing the frame on a time basis; and driving the display device in one of first to fourth modes according to a color characteristic of the image signal such that the first color light is emitted in the first sub frame in all of the modes, the second color light is emitted in the second sub frame in all of the modes, and at least one of the first color light and the second color light is emitted in both of the first and second sub frames in all except one of the modes.

18. The method of claim 17, wherein the display panel comprises a plurality of display blocks.

19. The method of claim 18, wherein, in providing a first color light and a second color light, each of the light source blocks respectively corresponding to the display blocks provides the first color light during a time period corresponding to a pulse width of a corresponding one of the first light source control signals, and the second color light during a time period corresponding to a pulse width of a corresponding one of the second light source control signals.

20. The method of claim 18, wherein the determining a pulse width of each of first light source control signals and second light source control signals according to a color characteristic of the image signal comprises:

dividing the image signal into a plurality of image groups respectively corresponding to the plurality of display blocks;

outputting first to third frequency signals corresponding to a color characteristic of each of the image groups;

determining an image type of each of the image groups based on the first to third frequency signals; and generating the first light source control signals and the second light source control signals, each having a pulse width set according to the determined image type.

21. The method of claim 20, wherein the generating the first light source control signals and the second light source control signals comprises:

selecting one of the first to fourth modes based on the determined image type.

22. The method of claim 21, wherein, in generating the first light source control signals and the second light source control signals, during the first mode, the light source blocks output the first light source control signals such that the first color light is provided within the first sub frame, and the light source blocks generate the second light source control signals such that the second color light is provided within the second sub frame.

23. The method of claim 21, wherein, in generating the first light source control signals and the second light source control signals, during the second mode, the light source blocks output the first light source control signals such that the first color light is provided within each of the first sub frame and the second sub frame, and the light source blocks generate the second light source control signals such that the second color light is provided within each of the first sub frame and the second sub frame.

24. The method of claim 21, wherein, in generating the first light source control signals and the second light source control signals, during the third mode, the light source blocks output the first light source control signals such that the first color light is provided within each of the first sub frame and the second sub frame, and the light source blocks generate the second light source control signals, such that the second color light is provided within the second sub frame.

25. The method of claim 21, wherein, in generating the first light source control signals and the second light source control signals, during the fourth mode, the light source blocks output the first light source control signals such that the first color light is provided within the first sub frame, and the light source blocks generate the second light source control signals such that the second color light is provided within each of the first sub frame and the second sub frame.

26. The method of claim 20, wherein the generating the first light source control signals and the second light source control signals comprises:

outputting a first luminance compensation signal and a second luminance compensation signal according to the determined image type.

27. The method of claim 26, wherein the providing the image signal to a display panel comprises compensating for a luminance of the image signal based on the first luminance compensation signal and the second luminance compensation signal.

* * * * *